US008600256B2

(12) United States Patent
Sakakibara et al.

(10) Patent No.: US 8,600,256 B2
(45) Date of Patent: Dec. 3, 2013

(54) CLEANING DEVICE AND IMAGE FORMING APPARATUS INCLUDING SAME

(75) Inventors: Yuu Sakakibara, Kanagawa (JP); Kenji Sugiura, Kanagawa (JP); Naomi Sugimoto, Kanagawa (JP); Hisashi Kikuchi, Kanagawa (JP); Yoshiki Hozumi, Kanagawa (JP); Osamu Naruse, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 374 days.

(21) Appl. No.: 13/178,025

(22) Filed: Jul. 7, 2011

(65) Prior Publication Data

US 2012/0008973 A1 Jan. 12, 2012

(30) Foreign Application Priority Data

Jul. 12, 2010 (JP) ..... 2010-158080

(51) Int. Cl.
*G03G 15/00* (2006.01)
*G03G 21/00* (2006.01)

(52) U.S. Cl.
USPC ..... 399/71; 399/354

(58) Field of Classification Search
USPC ..... 399/71, 123, 354
See application file for complete search history.

(56) References Cited

U.S. PATENT DOCUMENTS

| | | | |
|---|---|---|---|
| 5,526,100 | A | 6/1996 | Misago et al. |
| 5,592,267 | A | 1/1997 | Misago et al. |
| 6,799,012 | B2 | 9/2004 | Shakuto et al. |
| 6,987,944 | B2 | 1/2006 | Shakuto et al. |
| 7,062,212 | B2 | 6/2006 | Naruse et al. |
| 7,103,301 | B2 | 9/2006 | Watanabe et al. |
| 7,123,872 | B2 | 10/2006 | Shakuto et al. |
| 7,184,699 | B2 | 2/2007 | Naruse et al. |
| 7,209,699 | B2 | 4/2007 | Yamaguchi et al. |
| 7,369,807 | B2 | 5/2008 | Naruse et al. |
| 7,376,380 | B2 | 5/2008 | Koike et al. |
| 7,415,236 | B2 | 8/2008 | Nakano et al. |
| 7,415,238 | B2 | 8/2008 | Watanabe et al. |
| 7,496,324 | B2 | 2/2009 | Sugiura et al. |
| 7,505,728 | B2 | 3/2009 | Yamaguchi et al. |

(Continued)

FOREIGN PATENT DOCUMENTS

| | | |
|---|---|---|
| JP | 2006-251030 | 9/2006 |
| JP | 2007-25173 | 2/2007 |
| JP | 2008-76858 | 4/2008 |
| JP | 2009-145463 | 7/2009 |

*Primary Examiner* — Walter L Lindsay, Jr.
*Assistant Examiner* — Rodney Bonnette
(74) *Attorney, Agent, or Firm* — Oblon, Spivak, McClelland, Maier & Neustadt, L.L.P.

(57) ABSTRACT

A cleaning device disposed downstream from a transfer position in a direction of rotation of the image carrier to remove toner from the image carrier. The cleaning device includes a normally-charged toner cleaning member to electrostatically remove normally-charged toner from the image carrier, one of a polarity controller to control the toner on the image carrier to have a normal charging polarity and a reversely-charged toner cleaning member to electrostatically remove reversely-charged toner from the image carrier, a pre-cleaning member to electrostatically remove normally-charged toner from the image carrier, a pre-collection member to electrostatically collect the toner from the pre-cleaning member, and a control unit to reduce a voltage applied to the pre-cleaning member immediately after an untransferred toner image is removed from the image carrier by the pre-cleaning member below a voltage applied to the pre-cleaning member during removal of the untransferred toner image.

15 Claims, 12 Drawing Sheets

(56) References Cited

U.S. PATENT DOCUMENTS

| | | | | |
|---|---|---|---|---|
| 7,603,071 | B2 | 10/2009 | Sugiura et al. | |
| 7,610,008 | B2 | 10/2009 | Watanabe et al. | |
| 7,620,357 | B2 | 11/2009 | Shakuto et al. | |
| 7,873,298 | B2 * | 1/2011 | Yamashita et al. | 399/99 |
| 8,190,051 | B2 * | 5/2012 | Sano et al. | 399/101 |
| 8,433,213 | B2 | 4/2013 | Hozumi et al. | |
| 8,483,605 | B2 * | 7/2013 | Asaoka et al. | 399/354 |
| 2005/0058474 | A1 | 3/2005 | Watanabe et al. | |
| 2006/0209151 | A1 | 9/2006 | Tamiya et al. | |
| 2008/0286020 | A1 | 11/2008 | Watanabe et al. | |
| 2009/0176669 | A1 | 7/2009 | Sugiura et al. | |
| 2009/0311004 | A1 | 12/2009 | Naruse et al. | |
| 2010/0034549 | A1 | 2/2010 | Nakamatsu et al. | |
| 2010/0239302 | A1 | 9/2010 | Naruse et al. | |
| 2011/0103822 | A1 * | 5/2011 | Sugiura et al. | 399/101 |
| 2011/0158677 | A1 | 6/2011 | Kikuchi et al. | |
| 2011/0229187 | A1 * | 9/2011 | Hozumi et al. | 399/101 |
| 2011/0229234 | A1 | 9/2011 | Hozumi et al. | |
| 2012/0034006 | A1 * | 2/2012 | Asaoka et al. | 399/343 |
| 2012/0099883 | A1 * | 4/2012 | Kikuchi et al. | 399/71 |
| 2012/0224870 | A1 * | 9/2012 | Kikuchi et al. | 399/44 |

* cited by examiner

CLEANING DEVICE AND IMAGE FORMING APPARATUS INCLUDING SAME

CROSS-REFERENCE TO RELATED APPLICATIONS

The present patent application is based on and claims priority pursuant to 35 U.S.C. §119 from Japanese Patent Application No. 2010-158080, filed on Jul. 12, 2010, in the Japan Patent Office, which is incorporated herein by reference in its entirety.

BACKGROUND OF THE INVENTION

1. Field of the Invention

Exemplary aspects of the present invention generally relate to a cleaning device that removes toner from an image carrier using a cleaning member and an image forming apparatus including the cleaning device.

2. Description of the Background

Related-art image forming apparatuses, such as copiers, printers, facsimile machines, and multifunction devices having two or more of copying, printing, and facsimile functions, typically form a toner image on a transfer member (e.g., a sheet of paper, etc.) according to image data using an electrophotographic method. In such a method, for example, a charger charges a surface of a photoconductor; an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet of transfer members; and a fixing device applies heat and pressure to the sheet bearing the toner image to fix the toner image onto the sheet. The sheet bearing the fixed toner image is then discharged from the image forming apparatus.

There is known an electrostatic cleaning device that electrostatically removes residual normally-charged toner (e.g., negatively-charged toner) and reversely-charged toner (e.g., positively-charged toner) from an endless intermediate transfer belt serving as an image carrier. The electrostatic cleaning device includes a first cleaning unit that electrostatically removes the negatively-charged toner and a second cleaning unit that electrostatically removes the positively-charged toner. The first cleaning unit includes a first cleaning brush roller serving as a first cleaning member, to which a positive voltage is applied, and a first collection roller serving as a first collection member that collects the negatively-charged toner attached to the first cleaning brush roller. The second cleaning unit includes a second cleaning brush roller serving as a second cleaning member, to which a negative voltage is applied, and a second collection roller serving as a second collection member that collects the positively-charged toner attached to the second cleaning brush roller.

Each of the first and second cleaning brush rollers contacts the intermediate transfer belt at a position downstream from a secondary transfer position in a direction of rotation of the intermediate transfer belt and opposite a conductive opposing roller around which the intermediate transfer belt is wound. The opposing roller is electrically grounded, and an electric potential difference used for electrostatically cleaning the toner is formed between the intermediate transfer belt and each of the first and second cleaning brush rollers by the voltage applied to each of the first and second cleaning brush rollers. Toner charged to the normal polarity, that is, the negatively-charged toner, is electrostatically removed from the intermediate transfer belt by the first cleaning brush roller. Toner charged to the polarity opposite the normal polarity, that is, the positively-charged toner, is electrostatically removed from the intermediate transfer belt by the second cleaning brush roller.

In another approach, a cleaning device including a polarity control member that gives the toner on the intermediate transfer belt the normal polarity and a normally-charged toner cleaning brush roller that electrostatically removes the normally-charged toner from the intermediate transfer belt has been proposed. The polarity control member is provided upstream from the cleaning brush roller and is supplied with a voltage having the same polarity as the normal charging polarity of toner, that is, the negative polarity. A voltage having the polarity opposite the normal charging polarity of toner, that is, the positive polarity, is applied to the cleaning brush roller.

Each of the negatively-charged toner and the positively-charged toner on the intermediate transfer belt is given a negative polarity when passing through the polarity control member. Accordingly, the toner thus negatively-charged by the polarity control member is electrostatically removed from the intermediate transfer belt by the cleaning brush roller.

However, an untransferred toner image having a larger amount of toner, such as a toner pattern attached to the intermediate transfer belt, cannot be sufficiently removed from the intermediate transfer belt by the above-described related-art cleaning devices.

To solve the above-described problem, the applicant of the present invention has proposed an improved cleaning device that, in addition to the above-described components of the related art, further includes a pre-cleaning unit provided upstream from, for example, the first and second cleaning units in the first example of the related-art cleaning device, and from the polarity control member in the second example of the related-art cleaning device. The pre-cleaning unit includes a pre-cleaning brush roller serving as a pre-cleaning member, to which a positive voltage is applied, and a pre-collection roller serving as a pre-collection member that collects toner attached to the pre-cleaning brush roller. The pre-cleaning brush roller contacts the intermediate transfer belt at a position opposite a conductive pre-opposing roller, around which the intermediate transfer belt is wound. The pre-opposing roller is grounded, and a potential difference used for electrostatically cleaning the toner is formed between the intermediate transfer belt and the pre-cleaning brush rollers by the voltage applied to the pre-cleaning brush roller.

When the untransferred toner image mostly formed of the normally-charged toner, that is, the negatively-charged toner, is conveyed to the cleaning device, much of the negatively-charged toner is electrostatically moved to the pre-cleaning brush roller and removed from the intermediate transfer belt. Accordingly, an amount of toner conveyed to the first and second cleaning brush rollers or the polarity control member, each provided downstream from the pre-cleaning brush roller, is reduced. As a result, the toner still remaining on the intermediate transfer belt after passing through the pre-cleaning brush roller can be reliably removed by the configuration of the first or second example of the related-art cleaning device provided downstream from the pre-cleaning brush roller.

In a case in which the improved configuration is employed in the first example of the related-art cleaning device described above, any reattached toner is removed from the intermediate transfer belt by the second cleaning brush roller. However, the larger amount of reattached toner cannot be sufficiently removed from the intermediate transfer belt by the second cleaning brush roller alone.

By contrast, in a case in which the improved configuration is employed in the second example of the related-art cleaning device described above, the polarity of the reattached toner is reversed to the normal charging polarity, that is, the negative polarity, by the polarity control member so as to be removed from the intermediate transfer belt by the cleaning brush roller. However, in this case also, the larger amount of negatively-charged reattached toner cannot be sufficiently removed from the intermediate transfer belt by the cleaning brush roller alone.

SUMMARY

In view of the foregoing, illustrative embodiments of the present invention provide a novel cleaning device that can prevent toner attached to a pre-cleaning member from reattaching to an image carrier, and an image forming apparatus including the cleaning device.

In one illustrative embodiment, a cleaning device, disposed downstream from a transfer position where a toner image formed on an image carrier is transferred onto a transfer member in a direction of rotation of the image carrier to remove toner from the image carrier includes: a normally-charged toner cleaning member, to which a voltage having a polarity opposite a normal charging polarity of the toner is applied, provided in contact with the image carrier to electrostatically remove normally-charged toner from the image carrier; one of a polarity controller provided on an upstream side from the normally-charged toner cleaning member in the direction of rotation of the image carrier to control the toner on the image carrier to have the normal charging polarity and a reversely-charged toner cleaning member, to which a voltage having the same polarity as the normal charging polarity of the toner is applied, provided in contact with the image carrier on the upstream side from the normally-charged toner cleaning member to electrostatically remove reversely-charged toner from the image carrier; a pre-cleaning member, to which a voltage having the polarity opposite the normal charging polarity of the toner is applied, provided in contact with the image carrier on the extreme upstream side in the direction of rotation of the image carrier to electrostatically remove normally-charged toner from the image carrier; a pre-collection member, to which a voltage having the same polarity as and greater than the voltage applied to the pre-cleaning member is applied, provided in contact with the pre-cleaning member to electrostatically collect the toner from the pre-cleaning member; and a control unit to reduce the voltage applied to the pre-cleaning member immediately after an untransferred toner image, which is not transferred from the image carrier onto the transfer member at the transfer position, is removed from the image carrier by the pre-cleaning member below a voltage applied to the pre-cleaning member during removal of the untransferred toner image.

Another illustrative embodiment provides a cleaning device disposed downstream from a transfer position where a toner image formed on an image carrier is transferred onto a transfer member in a direction of rotation of the image carrier to remove toner from the image carrier. The cleaning device includes: a normally-charged toner cleaning member, to which a voltage having a polarity opposite a normal charging polarity of the toner is applied, provided in contact with the image carrier to electrostatically remove normally-charged toner from the image carrier; one of a polarity controller, to which a voltage having the same polarity as the normal charging polarity of the toner is applied, provided on an upstream side from the normally-charged toner cleaning member in the direction of rotation of the image carrier to control the toner on the image carrier to have the normal charging polarity and a reversely-charged toner cleaning member, to which a voltage having the same polarity as the normal charging polarity of the toner is applied, provided in contact with the image carrier on an upstream side from the normally-charged toner cleaning member to electrostatically remove reversely-charged toner from the image carrier; a pre-cleaning member, to which a voltage having the polarity opposite the normal charging polarity of the toner is applied, provided in contact with the image carrier on the extreme upstream side in the direction of rotation of the image carrier to electrostatically remove normally-charged toner from the image carrier; a pre-collection member, to which a voltage having the same polarity as and greater than the voltage applied to the pre-cleaning member is applied, provided in contact with the pre-cleaning member to electrostatically collect the toner from the pre-cleaning member; an electrically grounded pre-opposing member provided opposite the pre-cleaning member with the image carrier interposed therebetween; and a separation member to separate the pre-opposing member from the image carrier.

Yet another illustrative embodiment provides an image forming apparatus including an image carrier on which a toner image to be transferred onto a transfer member at a transfer position is formed, and the cleaning device described above.

Additional features and advantages of the present disclosure will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
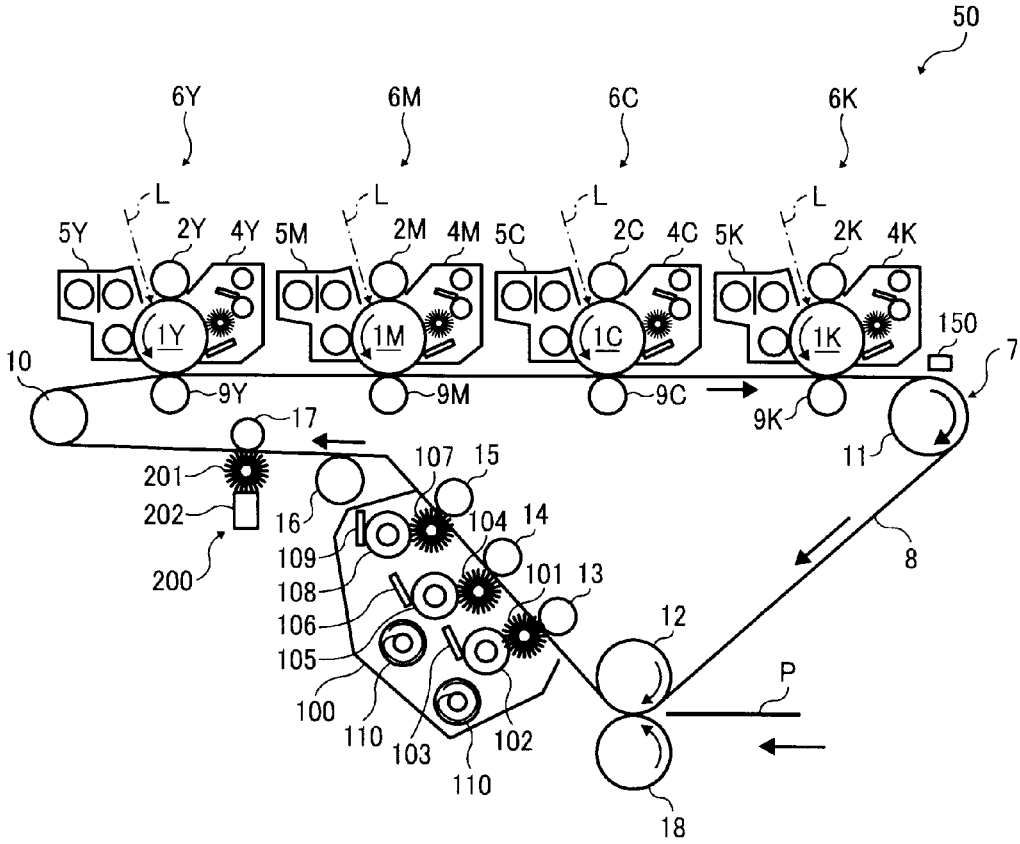
FIG. 1 is a vertical cross-sectional view illustrating an example of a configuration of a main part of an image forming apparatus according to illustrative embodiments.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

A configuration and operation of a tandem-type image forming apparatus 50 employing an intermediate transfer system according to illustrative embodiments are described in detail below.

FIG. 1 is a vertical cross-sectional view illustrating an example of a configuration of a main part of the image forming apparatus 50. The image forming apparatus 50 includes four process units 6Y, 6M, 6C, and 6K (hereinafter collectively referred to as process units 6) that form a toner image of a specific color, that is, yellow (Y), magenta (M), cyan (C), or black (K). The process units 6 includes drum-shaped photoconductors 1Y, 1M, 1C, and 1K each serving as a latent image carrier (hereinafter collectively referred to as photoconductors 1). Chargers 2Y, 2M, 2C, and 2K (hereinafter collectively referred to as chargers 2), developing devices 5Y, 5M, 5C, and 5K (hereinafter collectively referred to as developing devices 5), drum cleaning devices 4Y, 4M, 4C, and 4K (hereinafter collectively referred to as drum cleaning devices 4), neutralizing devices, not shown, and so forth are provided around the photoconductors 1, respectively. Each of the four process units 6 has the same basic configuration, differing only in the color of toner used. An optical unit, not shown, that directs laser light L onto surfaces of the photoconductors 1 to form electrostatic latent images on the surfaces of the photoconductors 1 is provided above the process units 6.

A transfer unit 7 including an endless intermediate transfer belt 8 is provided below the process units 6. The image forming apparatus 50 further includes multiple extension rollers provided inside a loop of the intermediate transfer belt 8 and components provided outside the loop of the intermediate transfer belt 8, such as a secondary transfer roller 18, a tension roller 16, a belt cleaning device 100, and a lubricant applicator 200.

The multiple extension rollers include four primary transfer rollers 9Y, 9M, 9C, and 9K (hereinafter collectively referred to as primary transfer rollers 9), a driven roller 10, a drive roller 11, an secondary transfer opposing roller 12, a first opposing roller 13 serving as a pre-opposing member, a second opposing roller 14, a third opposing roller 15, and an applicator opposing roller 17. The intermediate transfer belt 8 is wound around each of the above-described multiple extension rollers. It is to be noted that the first, second, and third opposing rollers 13, 14, and 15 do not necessarily apply a predetermined amount of tension to the intermediate transfer belt 8, and may be driven by rotation of the intermediate transfer belt 8. The intermediate transfer belt 8 is rotated in a clockwise direction in FIG. 1 by rotation of the drive roller 11 rotatively driven in the clockwise direction by drive means, not shown.

The primary transfer rollers 9 are provided opposite the photoconductors 1 with the intermediate transfer belt 8 interposed therebetween. Accordingly, primary transfer nips are formed at portions where the intermediate transfer belt 8 contacts each of the photoconductors 1. A primary transfer bias having a polarity opposite a polarity of toner is applied from a power source, not shown, to each of the primary transfer rollers 9.

The secondary transfer opposing roller 12 is provided opposite the secondary transfer roller 18 with the intermediate transfer belt 8 interposed therebetween. Accordingly, a secondary transfer nip is formed at a portion where the intermediate transfer belt 8 contacts the secondary transfer roller 18. It is to be noted that a secondary transfer bias having a polarity opposite the polarity of toner is applied from the power source, not shown, to the secondary transfer roller 18. Alternatively, a conveyance belt that conveys a sheet may be wound around the secondary transfer roller 18, multiple support rollers, and a drive roller. In such a case, the secondary transfer roller 18 is provided opposite the secondary transfer opposing roller 12 with both the intermediate transfer belt 8 and the conveyance belt interposed therebetween.

The first, second, and third opposing rollers 13, 14, and 15 are provided opposite first, second, and third cleaning brush rollers 101, 104, and 107 of the belt cleaning device 100, respectively, with the intermediate transfer belt 8 interposed therebetween. Accordingly, cleaning nips are formed at portions where the intermediate transfer belt 8 contacts each of the first, second, and third cleaning brush rollers 101, 104, and 107. The belt cleaning device 100 and the intermediate transfer belt 8 are integrally replaceable with a new component. Alternatively, the belt cleaning device 100 and the intermediate transfer belt 8 may be attached to and detached from the image forming apparatus 50 separately from each other in a case in which each of the belt cleaning device 100 and the intermediate transfer belt 8 has the different product life. A configuration of the belt cleaning device 100 is described in detail later.

The image forming apparatus 50 further includes a sheet feeder, not shown. The sheet feeder includes a sheet feed cassette that stores a transfer member such as a sheet P and a sheet feed roller that feeds the sheet P from the sheet feed cassette to a sheet feed path in the image forming apparatus 50. A pair of registration rollers, not shown, is provided on the right of the secondary transfer nip in FIG. 1 to temporarily stop conveyance of the sheet P fed from the sheet feeder so as to convey the sheet P to the secondary transfer nip at a predetermined timing. The sheet P is further conveyed from the secondary transfer nip to a fixing device, not shown, provided on the left of the secondary transfer nip in FIG. 1 to fix a toner image onto the sheet P. The image forming apparatus 50 may further include toner supplier that supplies toner to the developing devices 5, as needed.

In addition to plain paper widely used as the transfer member, special paper such as paper having an uneven surface and iron-on print paper used for thermal transfer is often used in recent years. Use of such special paper more often causes irregular secondary transfer of the toner image from the intermediate transfer belt 8 onto the sheet compared to use of the plain paper. Therefore, in the image forming apparatus 50, the intermediate transfer belt 8 has an elastic layer having less hardness so as to be provided with elasticity. Accordingly, the intermediate transfer belt 8 is deformable at the transfer nips in accordance with a toner layer in the toner image or the uneven surface of the sheet. As a result, the toner layer in the toner image can reliably contact the sheet without an excessive transfer pressure, thereby preventing irregular transfer of the toner image. Further, the toner image is evenly transferred onto the uneven surface of the sheet, thereby providing a higher-quality image having even image density.

Specifically, the intermediate transfer belt 8 is constructed of at least a base layer, the elastic layer, and a coating layer provided to the surface of the intermediate transfer belt 8.

The elastic layer of the intermediate transfer belt 8 is formed of an elastic material. Specific examples of the elastic material include, but are not limited to, elastic rubber, elastomer, butyl rubber, fluororubber, acrylic rubber, EPDM, NBR, acrylonitrile-butadiene-styrene rubber, natural rubber, isoprene rubber, styrene-butadiene rubber, butadiene rubber, urethane rubber, syndiotactic 1,2-polybutadiene, epichlorohydrine rubber, polysulfide rubber, polynorbornene rubber, and thermoplastic elastomer (e.g., polystyrene resin, polyolefin resin, polyvinyl chloride resin, polyurethane resin, polyamide resin, polyurea resin, polyester resin, or fluorocarbon resin). These materials can be used alone or in combination.

Although depending on the hardness and the structure of the intermediate transfer belt 8, a thickness of the elastic layer is preferably from 0.07 mm to 0.5 mm, and more preferably from 0.25 mm to 0.5 mm. When the intermediate transfer belt 8 is thinner than 0.07 mm, the pressure of the intermediate transfer belt 8 acting on toner at the secondary transfer nip is increased and transfer defects tend to occur, thereby degrading transfer efficiency of the toner.

It is preferable that the elastic layer have a JIS-A hardness of from 10° to 65°. Although the optimal hardness of the elastic layer depends on the thickness of the intermediate transfer belt 8, a hardness lower than the JIS-A hardness of 10° tends to cause transfer defects. By contrast, a hardness higher than the JIS-A hardness of 65° makes the intermediate transfer belt 8 difficult to be wound around the rollers. Further, the intermediate transfer belt 8 is stretched over time, thereby degrading durability and causing frequent replacement.

The base layer of the intermediate transfer belt 8 is formed of resin with less stretch. Specific examples of the material used for the base layer include, but are not limited to, polycarbonate, fluorocarbon resin (e.g., ETFE or PVDF), polystyrene, chloropolystyrene, poly-α-methylstyrene, styrene-budadiene copolymer, styrene-vinyl chloride copolymer, styrene-vinyl acetate copolymer, styrene-maleic acid copolymer, styrene-acrylate copolymer (e.g., styrene-methyl acrylate copolymer, styrene-ethyl acrylate copolymer, styrene-butyl acrylate copolymer, styrene-octyle acrylate copolymer, or styrene-phenyl acrylate copolymer), styrene-methacrylate ester copolymer (e.g., styrene-methyl methacrylate copolymer, styrene-ethyl methacrylate copolymer, or styrene-phenyl methacrylate copolymer), styrene-α-methyl chloroacrylate copolymer, styrene-acrylonitrile-acrylate ester copolymer, or similar styrene resin (e.g., polymer or copolymer containing styrene or substituted styrene), methyl methacrylate resin, butyl methacrylate resin, ethyl acrylate resin, butyl acrylate resin, modified acrylic resin (e.g., silicone modified acrylic resin, vinyl chloride resin modified acrylic resin, or acryl-urethane resin), vinyl chloride resin, styrene-vinyl acetate resin copolymer, vinyl chloride-vinyl acetate copolymer, rosin modulated maleic ester resin, phenol resin, epoxy resin, polyester resin, polyester-polyurethane resin, polyethylene, polypropylene, polybudadiene, polyvinylidene chloride, ionomer resin, polyurethane resin, silicone resin, ketone resin, ethylene-ethyl acrylate copolymer, xylene resin, polyvinyl butyral resin, polyamide resin, modified polyphenylene oxide resin, and combinations of two or more of the above-described materials.

It is to be note that, in order to prevent stretching of the elastic layer formed of the rubber material with a larger stretch, a core layer formed of a material such as a canvas may be provided between the base layer and the elastic layer of the intermediate transfer belt 8. Specific examples of the material used for the core layer include, but are not limited to, natural fibers such as cotton and silk, synthetic fibers such as polyester fibers, nylon fibers, acrylic fibers, polyorefine fibers, polyvinyl alcohol fibers, polyvinyl chloride fibers, polyvinylidene chloride fibers, polyurethane fibers, polyacetal fibers, polyfluoroethylene fibers, and phenol fibers, inorganic fibers such as carbon fibers and glass fibers, metal fibers such as iron fibers and copper fibers, and combinations of two or more of the above-described materials. The fibers may be configured as threads or textile and may be twisted in any suitable manner. The threads may be processed to have conductivity. The textile may be woven in any suitable manner such as tockinette, and may be provided with conductivity.

The surface of the elastic layer of the intermediate transfer belt 8 is coated with the coating layer having smoothness. Although not particularly limited to, materials that reduce adhesion of the toner to the surface of the intermediate transfer belt 8 so as to improve the secondary transfer efficiency is generally used for the coating layer. Specific examples of the material used for the coating layer include, but are not limited to, polyurethane resin, polyester resin, epoxy resin, and combinations of two or more of the above-described materials. Alternatively, a material that reduces surface energy so as to improve lubricating property, such as fluorocarbon resin grains, fluorine compound grains, carbon fluoride grains, titanium oxide grains, and silicon carbide grains with or without the grain size being varied may be used alone or in combination. Further, fluororubber may be heated to form a fluorine layer on the surface thereof, thereby reducing surface energy.

In order to adjust resistance, each of the base layer, the elastic layer, and the coating layer may be formed of metal powder such as carbon black, graphite, aluminum, and nickel, conductive metal oxides such as tin oxide, titanium oxide, antimony oxide, indium oxide, potassium titanate, ATO (antimony oxide-tin oxide), ITO (indium oxide-tin oxide), or the like. The conductive metal oxide may be coated with insulative fine grains such as, but are not limited to, barium sulfate, magnesium silicate, or calcium carbonate.

The lubricant applicator 200 applies a lubricant to the surface of the intermediate transfer belt 8 so as to protect the surface of the intermediate transfer belt 8. The lubricant applicator 200 includes a solid lubricant 202 formed of zinc stearate and an application brush roller 201 serving as an application member. The application brush roller 201 contacts the solid lubricant 202 to apply lubricant powder scraped from the lubricant 202 to the surface of the intermediate transfer belt 8 while rotating. The configuration of the lubricant applicator 200 is not limited to the above-described example, and may be set appropriately depending on the toner used in the image forming apparatus 50, the material of the intermediate transfer belt 8, and a frictional factor of the surface of the intermediate transfer belt 8.

When image data is sent from a personal computer or the like, the image forming apparatus 50 rotatively drives the drive roller 11 to rotate the intermediate transfer belt 8. The extension rollers other than the drive roller 11 are driven by rotation of the intermediate transfer belt 8. At the same time, the photoconductors 1 are rotatively driven. The chargers 2 evenly charge the surfaces of the photoconductors 1, and the laser light L is directed onto the charged surfaces of the photoconductors 1 to form electrostatic latent images of the specified color on the surfaces of the photoconductors 1, respectively. The electrostatic latent images thus formed on the surfaces of the photoconductors 1 are developed by the developing devices 5 so that toner images of the respective colors are formed on the surfaces of the photoconductors 1. The toner images of the respective colors are primarily transferred onto the intermediate transfer belt 8 at the primary transfer nips, respectively, and sequentially superimposed one atop the other to form a full-color toner image on the intermediate transfer belt 8.

Meanwhile, in the sheet feeder, not shown, the sheet P is fed one by one from the sheet feed cassette by the sheet feed roller to be conveyed to the pair of registration rollers. The pair of registration rollers is driven such that the sheet P is conveyed to the secondary transfer nip in synchronization with the full-color toner image formed on the intermediate transfer belt 8. Accordingly, the full-color toner image is secondarily transferred from the intermediate transfer belt 8 onto the sheet P. Thus, the full-color toner image is formed on the sheet P. The sheet p bearing the full-color toner image thereon is then conveyed from the secondary transfer nip to the fixing device to fix the full-color toner image onto the sheet P.

The drum cleaning devices 4 remove residual toner from the surfaces of the photoconductors 1, respectively, after primary transfer of the toner images from the surfaces of the photoconductors 1 onto the intermediate transfer belt 8. Thereafter, the neutralizing devices neutralize the surfaces of the photoconductors 1, and then the chargers 2 evenly charge the surfaces of the photoconductors 1 to be ready for the next sequence of image formation. The belt cleaning device 100 removes residual toner from the intermediate transfer belt 8 after secondary transfer of the full-color toner image from the intermediate transfer belt 8 onto the sheet P.

Figure 2:
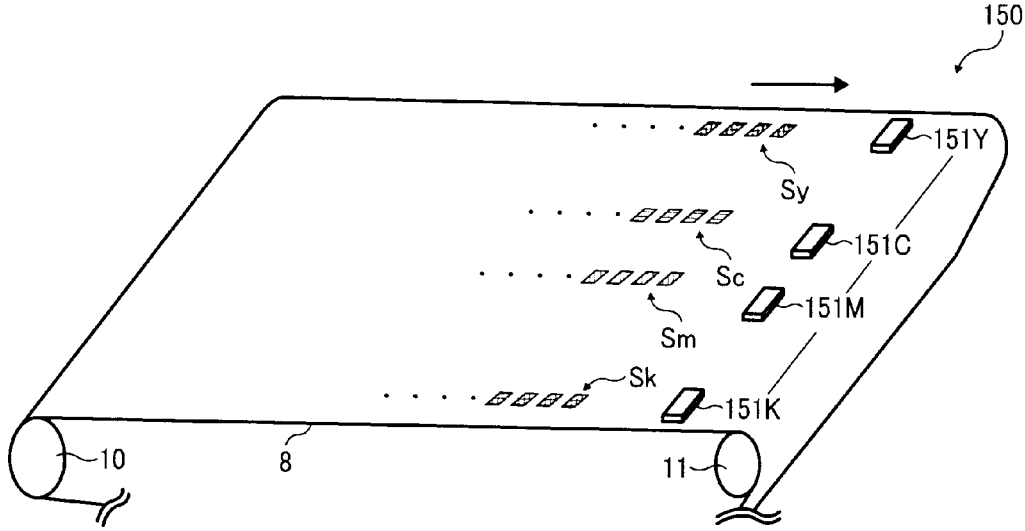
FIG. 2 is an enlarged schematic view illustrating gradation patterns formed on an intermediate transfer belt and optical sensors provided near the intermediate transfer belt.

On the right of the process unit 6K in FIG. 1, an optical sensor unit 150 is provided opposite the intermediate transfer belt 8 with a predetermined interval interposed therebetween. As illustrated in FIG. 2, the optical sensor unit 150 includes optical sensors 151Y, 151C, 151M, and 151K (hereinafter collectively referred to as optical sensors 151) arranged side by side in a width direction of the intermediate transfer belt 8. Each of the optical sensors 151 includes a reflective-type photosensor in which light emitted from a light emitter is reflected from the toner image on the intermediate transfer belt 8 and a light receiver detects an amount of the reflected light. A control unit, not shown, detects presence and an image density of the toner image on the intermediate transfer belt 8 based on an amount of voltage output from the optical sensors 151.

In order to adjust image density of each color, the image density is controlled each time the image forming apparatus 50 is turned on or images are formed on a predetermined number of the sheets P.

During image density control, first, graduation patterns Sk, Sm, Sc, and Sy (hereinafter collectively referred to as graduation patterns S) are automatically formed on the intermediate transfer belt 8 at positions opposite the optical sensors 151, respectively, as illustrated in FIG. 2. Each of the graduation patters S is formed of ten toner patches each having a size of 2 cm×2 cm with a different image density. Unlike during image formation in which the surfaces of the photoconductors 1 are evenly charged by the charger 2, a charging potential of each of the surfaces of the photoconductors 1 is gradually increased during formation of the graduation patterns S. Then, laser light is directed onto the surfaces of the photoconductors 1 to form electrostatic latent images for the multiple toner patches of the graduation patterns S on the surfaces of the photoconductors 1. The electrostatic latent images thus formed are then developed by the developing devices 5. During development, an amount of a developing bias applied to each of developing rollers respectively included in the developing devices 5 is gradually increased. As a result, the graduation patterns S of the specified color are formed on the surfaces of the photoconductors 1, respectively. The graduation patterns S are primarily transferred onto the intermediate transfer belt 8 so that the multiple toner patches of each of the graduation patterns S are arranged side by side at equal intervals in a main scanning direction of the intermediate transfer belt 8. At this time, an amount of toner attached to each of the toner patches is about from 0.1 $mg/cm^2$ to 0.55 $mg/cm^2$, and a charge amount (Q/d) distribution of the toner is substantially a normal charging polarity.

The graduation patterns S formed on the intermediate transfer belt 8 pass through the optical sensors 151 as the intermediate transfer belt 8 rotates. At this time, each of the optical sensors 151 receives an amount of light corresponding to an amount of toner attached to a unit area in each of the toner patches of the graduation patters S.

Next, the amount of toner attached to each of the toner patches of the graduation patterns S is calculated based on an amount of voltage output from each of the optical sensors 151 upon detection of the toner patches and a transformation algorithm so as to adjust image formation conditions based on the amount of toner thus calculated. Specifically, a linear function of $y=ax+b$ is calculated by regression analysis based on the amount of toner attached to each of the toner patches detected by the optical sensors 151 and a developing potential during formation of the toner patches. Then, a target image density is assigned to the linear function to calculate an appropriate developing bias and specify the developing bias for each toner color.

Memory stores a data table for image forming conditions in which several dozen combinations of developing biases and corresponding charging potentials are associated with each other. A developing bias that is the closest to the specified developing bias is selected from the data table for each of the process units 6, and the charging potential associated with the selected developing bias is specified.

Figure 3:
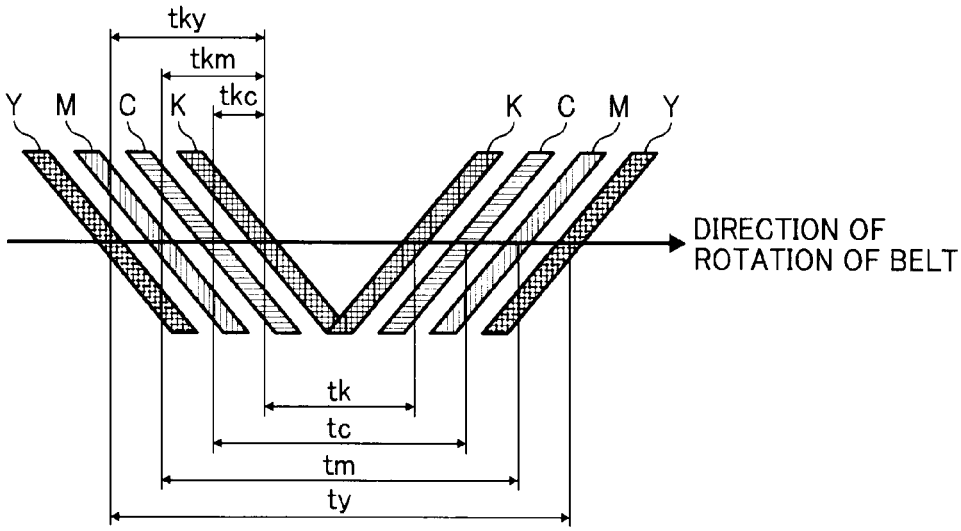
FIG. 3 is an enlarged view illustrating a chevron patch formed on the intermediate transfer belt.

In addition, an amount of color shift is corrected each time the image forming apparatus 50 is turned on or images are formed on a predetermined number of the sheets P. In order to correct an amount of color shift, an image for detecting color shift called chevron patch PV formed of toner images of yellow (Y), magenta (M), cyan (C), and black (K) as illustrated in FIG. 3 is formed at both edges of the intermediate transfer belt 8 in the width direction thereof. The chevron patch is a group of line patterns in which the toner images of the respective colors tilted at about 45° from the main scanning direction of the intermediate transfer belt 8 are arranged side by side at predetermined pitches in a sub-scanning direction, that is, the direction of rotation of the intermediate transfer belt 8. An amount of toner attached to the chevron patch PV is about 0.3 mg/cm$^2$.

The toner images of the respective colors in the chevron patch PV formed at both edges of the intermediate transfer belt 8 are detected so as to obtain a position of each of the toner images in both the main scanning direction (or an axial direction of the photoconductors 1) and the sub-scanning direction, a magnification error in the main scanning direction, and a skew from the main scanning direction. Here, the main scanning direction corresponds to a direction in which the laser light L reflected from the polygon mirror scans on the surfaces of the photoconductors 1. A difference in detection timings between the black toner image in the chevron patch PV and each of the yellow, magenta, and cyan toner images in the chevron patch PV is read by the optical sensors 151. The vertical direction in the surface of the sheet of paper on which FIG. 3 is drawn corresponds to the main scanning direction. Starting from the left in FIG. 3, the yellow (Y), magenta (M), cyan (C), and black (K) toner images are arranged side by side, in that order, and then the black (K), cyan (C), magenta (M), and yellow (Y) toner images each tilted at 90° from the former toner images, respectively, are further arranged side by side, in that order. Based on differences between actual measured values and theoretical values in differences in detection timing tky, tkm, and tkc from the black toner image (a reference color), an amount of positional shift in each of the toner images in the sub-scanning direction, that is, an amount of registration shift, is obtained. Then, based on the amount of registration shift thus obtained, a timing to start optical writing to the photoconductors 1 is corrected for every other surface of the polygon mirror so as to reduce the amount of registration shift in each of the toner images. In addition, an inclination (or a skew) of each of the toner images from the main scanning direction is obtained based on the difference in the positional shift between the edges of the intermediate transfer belt 8 in the sub-scanning direction. Based on the result thus obtained, optical face tangle error in the reflective mirror is corrected so as to reduce a skew shift in each of the toner images. Thus, the timing to start optical writing and the optical face tangle error are corrected based on the timings for detecting the toner images in the chevron patch PV, and the registration shift and the skew shift are reduced so as to correct the color shift. Accordingly, a color shift in the resultant image caused by a shift in formation positions of the toner images on the intermediate transfer belt 8 over time due to temperature changes or the like can be prevented.

When images having less image area are continuously formed, an amount of old toner stored in the developing devices 5 over time is increased. Consequently, charging property of the toner is deteriorated, thereby degrading image quality. In order to prevent accumulation of such old toner in the developing devices 5, a refresh mode is activated such that the old toner is discharged to the non-image forming portion onto each of the surfaces of the photoconductors 1 at a predetermined timing so as to supply fresh toner to the developing devices 5.

An amount of toner consumed and an operating time for each of the developing devices 5 are stored in the control unit, not shown. The control unit checks whether or not the amount of consumed toner is smaller than a threshold at a predetermined timing for each operating time of the developing devices 5 during a predetermined period of time. When the amount of consumed toner is less than the threshold, the refreshing mode is activated for the corresponding developing devices 5.

During the refresh mode, a toner consumption pattern having a size of 25 mm×250 mm is formed at a non-image formation portion on each of the surfaces of the photoconductors 1, which corresponds to an interval between each of the sheets P. The toner consumption pattern thus formed is then transferred onto the intermediate transfer belt 8. An amount of toner attached to the toner consumption pattern is determined based on an amount of toner consumed in the operating time of the developing devices 5 during a predetermined period of time, and the maximum amount of toner attached to a unit area may be about 1.2 mg/cm$^2$. A charge amount (Q/d) distribution of the toner in the toner consumption pattern transferred onto the intermediate transfer belt 8 is substantially a normal charging polarity.

Each of the graduation pattern S, the chevron patch PV, and the toner consumption pattern formed on the intermediate transfer belt 8 is collected by the belt cleaning device 100. At this time, a larger amount of toner is removed from the intermediate transfer belt 8 by the belt cleaning device 100. However, the related-art cleaning devices cannot remove an untransferred toner image such as the graduation patterns S, the chevron patch PV, or the toner consumption pattern all at once. Consequently, residual toner which cannot be removed by the cleaning device and still remains on the intermediate transfer belt 8 may be transferred onto the sheet together with a toner image for the next sequence of image formation, causing an irregular image.

To solve the above-described problems, the belt cleaning device 100 according to illustrative embodiments is configured to reliably remove the untransferred toner images, such as the graduation patterns S, the chevron patch PV, and the toner consumption pattern, which are conveyed to the belt cleaning devices 100 without being transferred onto the sheet.

Figure 4:
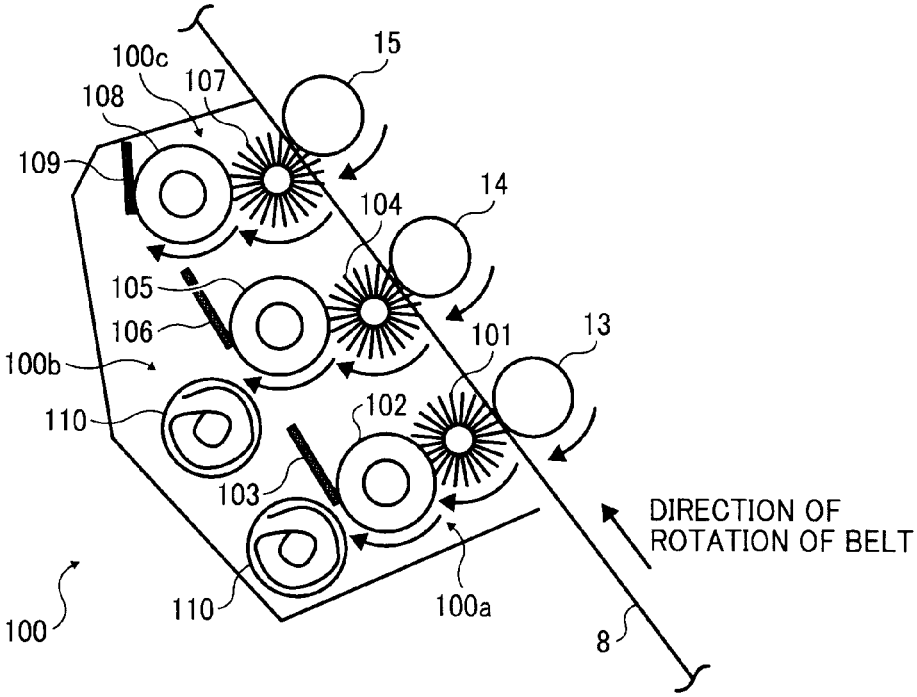
FIG. 4 is a schematic view illustrating an example of a configuration of a belt cleaning device and surrounding components according to illustrative embodiments.

FIG. 4 is a schematic view illustrating an example of a configuration of the belt cleaning device 100 and surrounding components.

The belt cleaning device 100 includes a pre-cleaning part (first cleaning part) 100*a* that removes much of the untransferred toner images from the intermediate transfer belt 8; a reversely-charged toner cleaning part (second cleaning part) 100*b* that removes positively-charged toner, which is charged to the polarity opposite a normal charging polarity of the toner, from the intermediate transfer belt 8; and a normally-charged toner cleaning part (third cleaning part) 100*c* that removes negatively-charged toner, which is charged to the normal charging polarity of the toner, from the intermediate transfer belt 8.

The first cleaning part 100*a* includes a pre-cleaning brush roller (first cleaning brush roller) 101 serving as a pre-cleaning member. The first cleaning part 100*a* further includes a pre-collection roller (first collection roller) 102 serving as a pre-collection member that collects toner attached to the first brush roller 101 and a pre-scraping blade (first scraper) 103 that contacts the first collection roller 102 to scrape off the toner from a surface of the first collection roller 102.

Most of toner in the untransferred toner image is normally charged to the negative polarity. Therefore, a voltage having a polarity opposite the normal charging polarity of the toner, that is, the positive polarity, is applied to the first cleaning brush roller 101 to electrostatically remove the negatively-charged toner from the intermediate transfer belt 8. In addition, a positive voltage greater than the voltage applied to the first cleaning brush roller 101 is applied to the first collection roller 102.

The second cleaning part 100*b* is provided downstream from the first cleaning part 100*a* in the direction of rotation of intermediate transfer belt 8, and includes a reversely-charged toner cleaning brush roller (second cleaning brush roller) 104 serving as a reversely-charged toner cleaning member that electrostatically removes reversely-charged toner (positively-charged toner) charged to the polarity opposite the normal charging polarity of the toner. The second cleaning part 100*b* further includes a reversely-charged toner collection roller (second collection roller) 105 serving as a reversely-charged toner collection member that collects the positively-charged toner attached to the second cleaning brush roller 104 and a reversely-charged toner scraping blade (second scraper) 106 that contacts the second collection roller 105 to scrape off the positively-charged toner from a surface of the second collection roller 105. A negative voltage is applied to the second cleaning brush roller 104. In addition, a negative voltage greater than the negative voltage applied to the second cleaning brush roller 104 is applied to the second collection roller 105. Further, the second cleaning part 100*b* functions also as a polarity controller that applies negative electric charges to the toner on the intermediate transfer belt 8 such that the toner on the intermediate transfer belt 8 has the normal charging polarity, that is, the negative polarity.

The third cleaning part 100*c* is provided downstream from the second cleaning part 100*b* in the direction of rotation of the intermediate transfer belt 8, and includes a normally-charged toner cleaning brush roller (third cleaning brush roller) 107 serving as a normally-charged toner cleaning member that electrostatically removes the negatively-charged toner from the intermediate transfer belt 8. The third cleaning part 100*c* further includes a normally-charged toner collection roller (third collection roller) 108 serving as a normally-charged toner collection member that collects the negatively-charged toner attached to the third cleaning brush roller 107 and a normally-charged toner scraping blade (third scraper) 109 that contacts the third collection roller 108 to scrape off the negatively-charged toner from a surface of the third collection roller 108. A positive voltage is applied to the third cleaning brush roller 107. In addition, a positive voltage greater than the positive voltage applied to the third cleaning brush roller 107 is applied to the third collection roller 108.

The belt cleaning device 100 further includes conveyance screws 110 that convey the collected toner to a waste toner tank, not shown, provided to the image forming apparatus 50. Although the collected toner is conveyed to the waste toner tank provided outside the belt cleaning device 100 via the conveyance screws 110 in illustrative embodiments, alternatively, a waste toner case may be provided within the belt cleaning device 100 to store the collected toner therein. The waste toner case may be detachably attached to the belt cleaning device 100 so as to be detached from the belt cleaning device 100 to remove the toner stored therein during maintenance.

Each of the first, second, and third cleaning brush rollers 101, 104, and 107 has an outer diameter of from ϕ15 mm to ϕ16 mm, and is constructed of a metal rotary shaft rotatably supported and a brush part formed of multiple fibers provided to a circumference of the metal rotary shaft. Each of the multiple fibers has a core-in-sheath type structure in which a conductive material such as conductive carbon is dispersed into an insulating material such as polyester provided in a surface layer of the fiber. Accordingly, a core of the fiber has an electric potential substantially the same as the voltage applied to each of the cleaning brush rollers 101, 104, and 107, thereby electrostatically attracting the toner to the surface of the fiber. Thus, the toner on the intermediate transfer belt 8 is electrostatically attached to the fibers by the voltage applied to each of the cleaning brush rollers 101, 104, and 107. It is to be noted that, alternatively, the fibers of each of the cleaning brush rollers 101, 104, and 107 may not have a core-in-sheath type structure, but may be formed only of conductive fibers. In addition, the fibers may be transplanted to the rotary shaft of each of the cleaning brush rollers 101, 104, and 107 at an angle in a direction of a normal line of the rotary shaft. Further alternatively, the fibers of the first and third cleaning brush roller 101 and 107 may have a core-in-sheath type structure while the fibers of the second cleaning brush roller 104 may be formed of conductive fibers only. The fibers of the second cleaning brush roller 104 formed only of the conductive fibers can easily inject electric charges into the toner. As a result, the toner on the intermediate transfer belt 8 can be reliably controlled to have the negative polarity by the second cleaning brush roller 104. By contrast, the core-in-sheath type structure of the fibers in the first and third cleaning brush rollers 101 and 107 can suppress the charge injection into the toner, thereby preventing the toner on the intermediate transfer belt 8 from being positively charged. Accordingly, generation of residual toner which is not electrostatically removed from the intermediate transfer belt 8 by the first or third cleaning brush roller 101 or 107 can be prevented.

Each of the cleaning brush rollers 101, 104, and 107 contacts the intermediate transfer belt 8 with an engagement of 1 mm, and is rotated by drive means, not shown, such that the fibers of each of the cleaning brush rollers 101, 104, and 107 are moved in a direction opposite the direction of rotation of the intermediate transfer belt 8 at a contact portion where the fibers contact the intermediate transfer belt 8. Accordingly, a difference in linear velocity between the intermediate transfer belt 8 and each of the cleaning brush rollers 101, 104, and 107 can be increased at the contact portion. As a result, the fibers of each of the cleaning brush rollers 101, 104, and 107 can more reliably contact the intermediate transfer belt 8 at the contact portion, thereby more optimally removing the toner from the intermediate transfer belt 8.

Each of the first, second, and third collection rollers 102, 105, and 108 has an SUS roller. It is to be noted that, any material may be used for the collection rollers 102, 105, and 108 as long as the toner attached to the cleaning brush rollers 101, 104, and 107 is translocated to the collection rollers 102, 105, and 108, respectively, using a potential gradient between the collection rollers 102, 105, and 108 and the fibers of the cleaning brush rollers 101, 104, and 107. For example, a conductive metal core of each of the collection rollers 102, 105, and 108 may be coated with a high-resistance elastic tube having a thickness of from several μm to 100 μm and be further coated with an insulating material, such that each of the collection rollers 102, 105, and 108 has a roller resistance log R of from 12Ω to 13Ω. Use of the SUS roller for each of the collection rollers 102, 105, and 108 can reduce production costs, applied voltages, and power consumption. Further, setting the roller resistance log R to the above-described range of from 12Ω to 13Ω suppresses the charge injection into the toner upon collection of the toner to the collection rollers 102, 105, and 108. As a result, the toner has the same polarity as the polarity of the voltage applied to each of the collection rollers 102, 105, and 108, thereby being reliably collected by the collection rollers 102, 105, and 108.

As described above, the fibers of each of the cleaning brush rollers 101, 104, and 107 are formed of conductive polyester and have a core-in-sheath type structure in which conductive carbon is included within a fiber and a surface of the fiber is coated with polyester. Each of the cleaning brush rollers 101, 104, and 107 has a resistivity of from $10^6$Ω to $10^8$Ω and a density of 100,000 fibers per square inch. Each of the brush fibers has a diameter of about from 25 μm to 35 μm, and a leading edge of the brush fiber is not bent. Each of the cleaning brush rollers 101, 104, and 107 has a diameter of from ϕ15 mm to ϕ16 mm, and contacts the intermediate transfer belt 8 with an engagement of 1 mm. A voltage of from +1,600 V to +4,000 V is applied to the rotary shaft of the first cleaning brush roller 101. A voltage of from −3,200 V to −4,000 V is applied to the rotary shaft of the second cleaning brush roller 104. A voltage of from +800 V to +1,600 V is applied to the rotary shaft of the third cleaning brush roller 107.

The voltage applied to the first cleaning brush roller 101 is set such that even the untransferred toner image having a larger amount of toner can be reliably removed from the intermediate transfer belt 8. In addition, an absolute value of the voltage applied to the second cleaning brush roller 104 is set slightly higher so as to inject electric charges into the toner on the intermediate transfer belt 8. It is to be noted that the configuration of the cleaning brush rollers 101, 104, and 107 is not limited to the above-described example, and may be optimized depending on the system. Examples of the fibers for use in the fiber are, but are not limited to, nylon, acrylic, and polyester.

A metal core of each of the collection rollers 102, 105, and 108 is formed of SUS. The fibers of each of the cleaning brush rollers 101, 104, and 107 contact the collection rollers 102, 105, and 108 with an engagement of 1.5 mm, respectively. A voltage of from +2,000 V to +4,400 V is applied to the metal core of the first collection roller 102. A voltage of from −3,600 to −4,400 is applied to the metal core of the second collection roller 105. A voltage of from +1,200 to +2,000 is applied to the metal core of the third collection roller 108.

It is to be noted that the configuration of the collection rollers 102, 105, and 108 is not limited to the above-described example, and may be optimized depending on the system.

Each of the first, second, and third scrapers 103, 106, and 109 has a thickness of 0.1 mm and contacts the surfaces of the collection rollers 102, 105, and 108 with an engagement of 1.0 mm, respectively, so as to face in the rotation direction of the collection rollers 102, 105, and 108 at a contact angle of 20°.

It is to be noted that the configuration of the scrapers 103, 106, and 109 is not limited to the above-described example, and may be optimized depending on the system.

A description is now given of operation of the belt cleaning device 100.

Residual toner and the untransferred toner image on the intermediate transfer belt 8 passing through the secondary transfer position is conveyed to the first cleaning brush roller 101 by rotation of the intermediate transfer belt 8. As described above, a positive voltage is applied to the first cleaning brush roller 101. Accordingly, the negatively-charged toner on the intermediate transfer belt 8 is electrostatically attached to the first cleaning brush roller 101 by a magnetic field formed by a potential difference between the intermediate transfer belt 8 and the first cleaning brush roller 101. Then, the negatively-charged toner attached to the first cleaning brush roller 101 is conveyed to a contact position where the first cleaning brush roller 101 contacts the first collection roller 102, to which a positive voltage greater than the voltage applied to the first cleaning brush roller 101 is applied. At the contact position, the toner on the first cleaning brush roller 101 is electrostatically attached to the first collection roller 102 by a magnetic field formed by a potential difference between the first cleaning brush roller 101 and the first collection roller 102. The negatively-charged toner thus attached to the first collection roller 102 is then scraped off from the first collection roller 102 by the first scraper 103. The toner thus scraped off is discharged from the belt cleaning device 100 by the conveyance screws 110.

The toner in the untransferred toner image which cannot be removed by the first cleaning brush roller 101 and the positively-charged residual toner that still remains on the intermediate transfer belt 8 after passing through the first cleaning brush roller 101 are further conveyed to the second cleaning brush roller 104. As described above, a negative voltage is applied to the second cleaning brush roller 104, so that the toner remaining on the intermediate transfer belt 8 is given a negative polarity by charge injection or electric discharge. Positively-charged toner that is not given a negative polarity is attached to the second cleaning brush roller 104 to be removed from the intermediate transfer belt 8 by a magnetic field formed by a potential difference between the intermediate transfer belt 8 and the second cleaning brush roller 104. Then, the positively-charged toner attached to the second cleaning brush roller 104 is conveyed to a contact position where the second cleaning brush roller 104 contacts the second collection roller 105, to which a negative voltage greater than the voltage applied to the second cleaning brush roller 104 is applied. The positively-charged toner on the second cleaning brush roller 104 is electrostatically attached to the second collection roller 105 by a magnetic field formed by a potential difference between the second cleaning brush roller 104 and the second collection roller 105. Then, the positively-charged toner thus attached to the second collection roller 105 is scraped off from the second collection roller 105 by the second scraper 106.

Thereafter, the toner which is negatively charged by the second cleaning brush roller 104 and the negatively-charged toner that cannot be removed by the first cleaning brush roller 101 and still remains on the intermediate transfer belt 8 after passing through the second cleaning brush roller 104 are further conveyed to the third cleaning brush roller 107. As described above, the toner thus conveyed to the third cleaning brush roller 107 is given a negative polarity by the second cleaning brush roller 104. In addition, by this time most of the toner has already been removed from the intermediate transfer belt 8 by the first and second cleaning brush rollers 101 and 104. Therefore, only a slight amount of toner is conveyed to the third cleaning brush roller 107. The slight amount of the negatively-charged toner on the intermediate transfer belt 8 conveyed to the third cleaning brush roller 107 is electrostatically attached to the third cleaning brush roller 107, to which a positive voltage is applied. Thereafter, the toner is collected by the third collection roller 108, and is scraped off from the third collection roller 108 by the third scraper 109.

Figure 5:
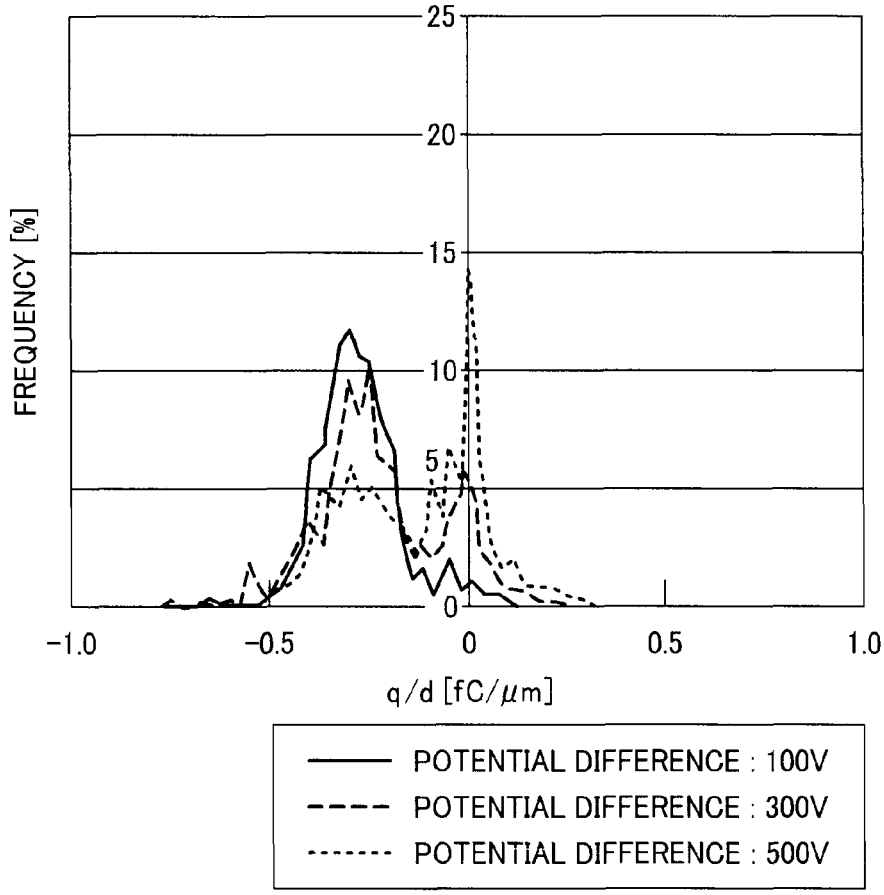
FIG. 5 is a graph illustrating a relation between a potential difference between a first cleaning brush roller and a first collection roller and charge distributions of uncollected toner.

FIG. 5 is a graph illustrating a relation between the potential difference between the first cleaning brush roller 101 and the first collection roller 102 and the charge distributions of the uncollected toner. The charge distributions of the toner were measured using an E-SPART analyzer manufactured by Hosokawa Micron Corporation. When the potential difference between the first cleaning brush roller 101 and the first collection roller 102 is 100 V, little positively-charged toner is in the charge distribution. By contrast, when the potential difference between the first cleaning brush roller 101 and the first collection roller 102 is 300 V or 500 V, the amount of positively-charged toner is increased. However, the largest amount of toner was collected from the first cleaning brush roller 101 to the first collection roller 102 when the potential difference is 400 V. In other words, an increase in the amount of toner collected to the first collection roller 102 generates positively-charged toner. The positively-charged toner is not electrostatically attached to the first collection roller 102 by the potential difference between the first collection roller 102 and the first cleaning brush roller 101, and remains on the first cleaning brush roller 101, resulting in uncollected toner. When conveyed to a pre-cleaning nip where the first cleaning brush roller 101 and the intermediate transfer belt 8 contact each other, the uncollected toner remaining on the first cleaning brush roller 101 is attached to the intermediate transfer belt 8 again due to the potential difference between the first cleaning brush roller 101 and the intermediate transfer belt 8.

An amount of toner reattached to the intermediate transfer belt 8 (hereinafter referred to as reattached toner) increases as the amount of toner in the untransferred toner image conveyed to the belt cleaning device 100 increases. In particular, when the toner consumption pattern having a toner amount of 1.2 mg/cm$^2$ is conveyed to the belt cleaning device 100, the amount of reattached toner is increased to about 0.05 mg/cm$^2$, which may be larger than an amount of toner in a toner consumption pattern A remaining on the intermediate transfer belt 8 without being removed by the first cleaning brush roller 101 illustrated in FIG. 6.

Figure 6:
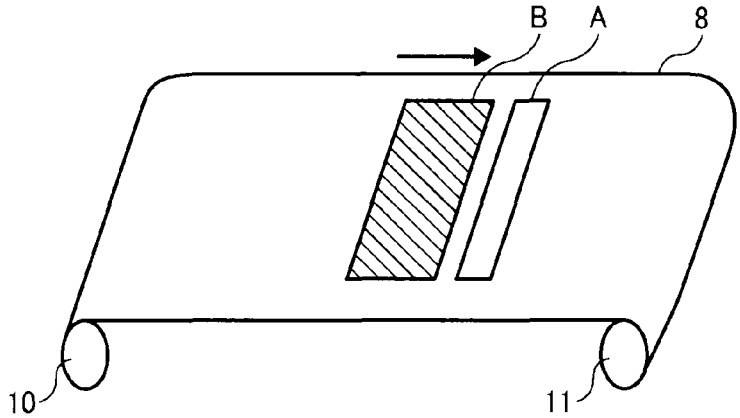
FIG. 6 is a schematic view illustrating a toner consumption pattern and a reattached toner pattern formed on the intermediate transfer belt.

When the untransferred toner image having a toner amount of less than 0.6 mg/cm$^2$, such as the graduation patterns S and the chevron pattern PV, is conveyed to the belt cleaning device 100, only a slight amount of toner is reattached to the intermediate transfer belt 8. However, when the untransferred toner image having a toner amount of 0.6 mg/cm$^2$ or more, such as the toner consumption pattern, is conveyed to the belt cleaning device 100, a reattached toner pattern B as illustrated in FIG. 6 is formed on the intermediate transfer belt 8 by the toner reattached to the intermediate transfer belt 8 from the first cleaning brush roller 101. The reattached toner pattern B has a toner amount in a range of from about 0.02 mg/cm$^2$ to about 0.07 mg/cm$^2$. An interval between the toner consumption pattern A and the reattached toner pattern B, shown respectively in FIG. 6, is determined by the rotational speed of each of the first cleaning brush roller 101 and the intermediate transfer belt 8. Specifically, the reattached toner pattern B is formed on the intermediate transfer belt 8 when the first cleaning brush roller 101 makes a single revolution after the toner consumption pattern A passes the pre-cleaning nip. In the illustrative embodiments described herein, the intermediate transfer belt 8 is rotated at 350 mm/sec, and the first cleaning brush roller 101 is rotated at 350 mm/sec in a direction opposite the direction of rotation of the intermediate transfer belt 8 at the contact portion where the first cleaning brush roller 101 contacts the intermediate transfer belt 8. A width of the toner consumption pattern A is 25 mm. Thus, the interval between the toner consumption pattern A and the reattached toner pattern B is 22 mm. Most of the reattached toner in the reattached toner pattern B is positively charged. The second cleaning brush roller 104 negatively charges the reattached toner pattern B so as to be removed by the third cleaning brush roller 107. A part of the reattached toner which cannot be negatively-charged by the second cleaning brush roller 104 is removed by the second cleaning brush roller 104.

In recent years, longer product life as well as a larger volume of print jobs achieved by the electrophotographic method is desired for image forming apparatuses. For these reasons, an endurance test in which images are formed on 800,000 sheets of paper was performed for the belt cleaning device 100. As a result, a toner consumption pattern having a toner amount of 1.2 mg/cm$^2$ was optimally removed by the belt cleaning device 100 upon formation of images on 400,000 sheets. However, upon formation of images on 800,000 sheets a slight part of the toner consumption pattern was found to have not been cleaned by the belt cleaning device 100, causing blots on the sheets. It is conceivable that the outer diameter of each of the cleaning brush rollers 101, 104, and 107 is decreasing over time. Consequently, although the residual toner can still be reliably removed, it is difficult to optimally remove the untransferred toner image having a larger amount of toner from the intermediate transfer belt 8.

The causes for irregular cleaning performance of the belt cleaning device 100 upon formation of images on 800,000 sheets were further examined and the following facts established. That is, when a toner consumption pattern has the maximum toner amount of 1.2 mg/cm$^2$, the reattached toner pattern B has a toner amount of about 0.05 mg/cm$^2$, which is larger than the toner amount in the unremoved toner consumption pattern A shown in FIG. 6. In the earliest stage of use of the belt cleaning device 100, the reattached toner pattern B having a toner amount of about 0.05 mg/cm$^2$ was reliably removed from the intermediate transfer belt 8 by the second and third cleaning brush rollers 104 and 107. However, as described above, the outer diameter of each of the cleaning brush rollers 101, 104, and 107 is decreasing over time. Consequently, an attached surface in each of the cleaning brush rollers 101, 104, and 107 to which the toner is attached is decreased, thereby degrading cleaning performance. As a result, the larger amount of reattached toner of about 0.05 mg/cm$^2$ negatively charged by the second cleaning part 100*b* cannot be removed by the third cleaning brush roller 107, thereby causing irregular cleaning performance.

To solve the above-described problems, an amount of reattached toner is decreased to achieve optimal cleaning performance over time in the belt cleaning device 100. A first illustrative embodiment of the present invention is described in detail below with reference to FIG. 7.

Figure 7:
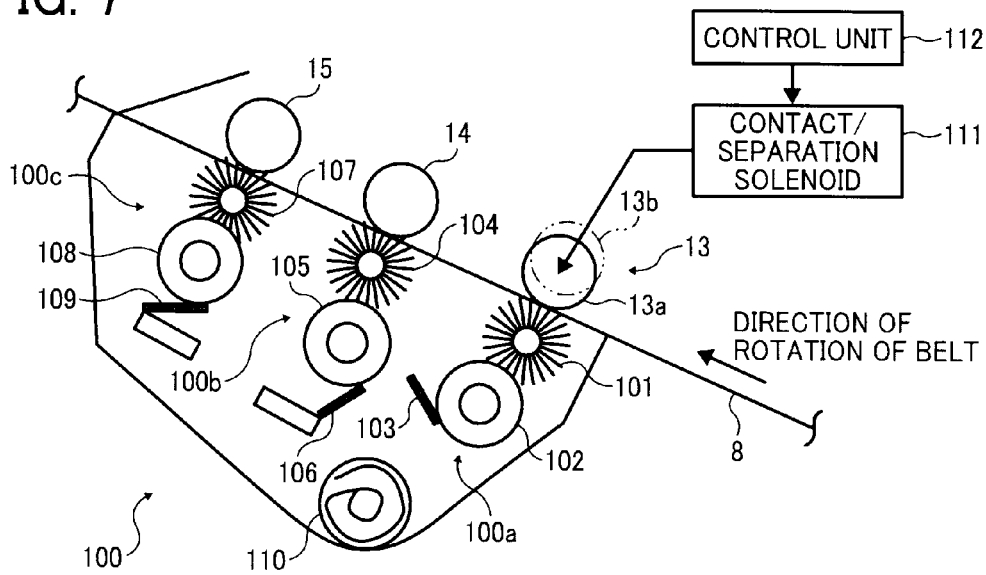
FIG. 7 is a schematic view illustrating a configuration of a belt cleaning device according to a first illustrative embodiment.

FIG. 7 is a schematic view illustrating a configuration of the belt cleaning device 100 according to the first illustrative embodiment.

In the first illustrative embodiment, the first opposing roller 13 is separatably contactable to the intermediate transfer belt 8. A bearing, not shown, that rotatably supports a rotary shaft of the first opposing roller 13 is movably supported in a direction perpendicular to the surface of the intermediate transfer belt 8. A contact/separation solenoid 111 serving as a separation member is provided to move the bearing in the direction perpendicular to the surface of the intermediate transfer belt 8. A control unit 112 that controls driving of the contact/separation solenoid 111 is connected to the contact/separation solenoid 111.

Figure 8:
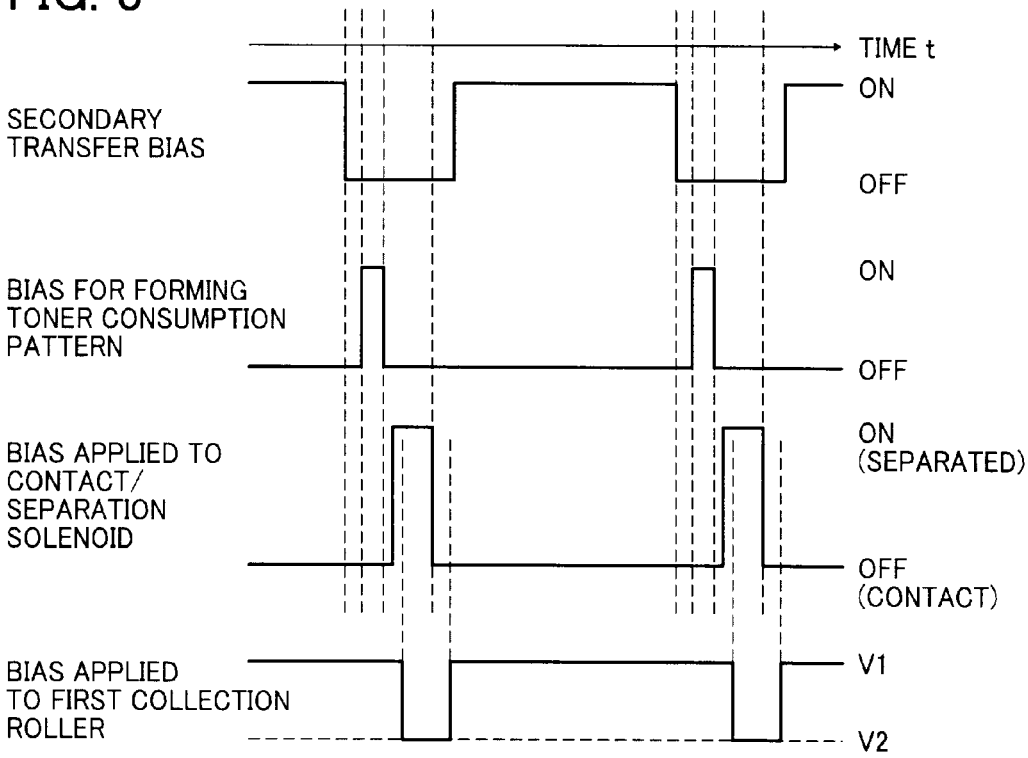
FIG. 8 is a timing chart illustrating application of voltages according to the first illustrative embodiment.
Figure 9:
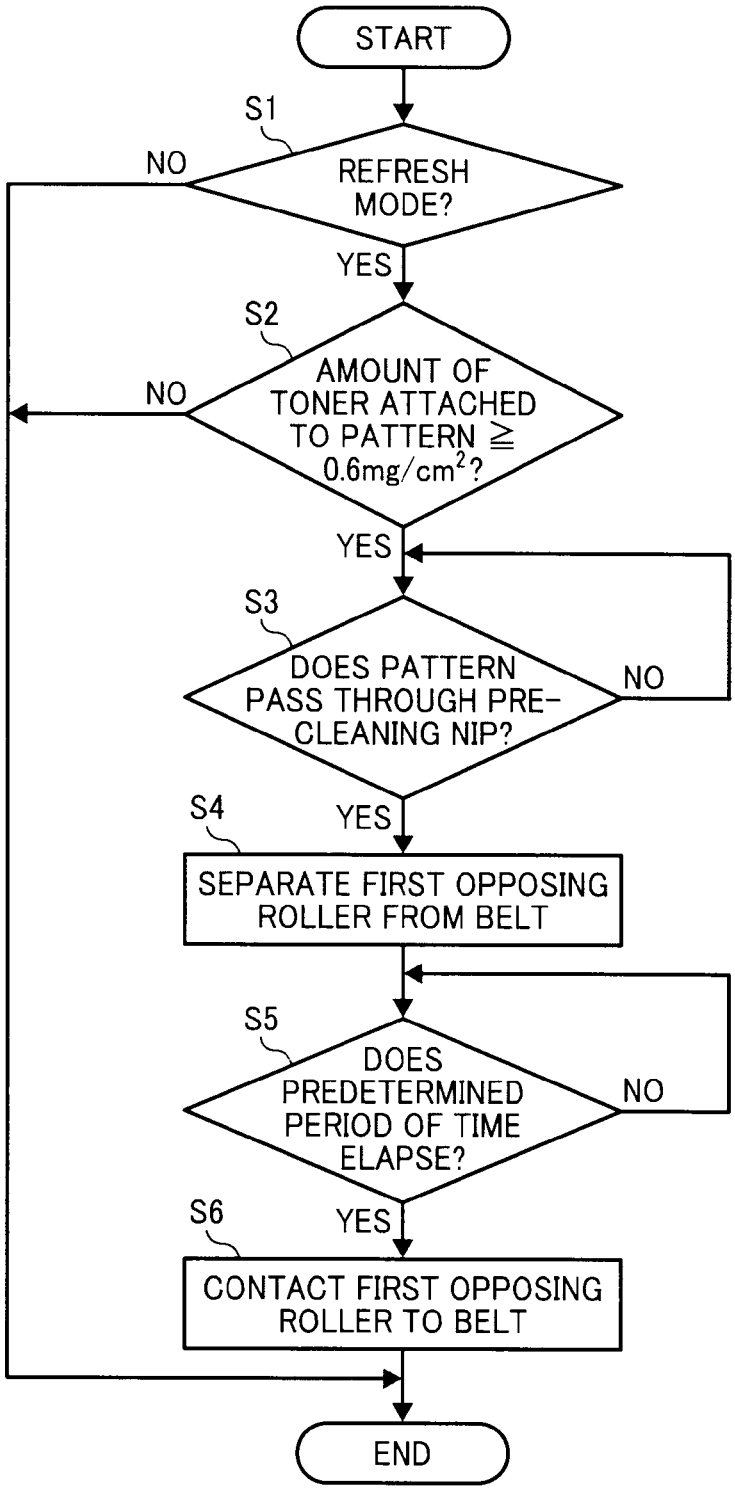
FIG. 9 is a flowchart illustrating steps in a process of operation of the belt cleaning device according to the first illustrative embodiment.

FIG. 8 is a timing chart illustrating application of the voltages according to the first illustrative embodiment. FIG. 9 is a flowchart illustrating steps in a process of operation of the belt cleaning device 100 according to the first illustrative embodiment.

When the image forming apparatus 50 is moved to the refresh mode (YES at step S1), the process proceeds to step S2 so that the control unit 112 checks whether or not a toner amount in a toner consumption pattern is equal to or greater than 0.6 mg/cm$^2$. When the toner amount in the toner consumption pattern is 0.6 mg/cm$^2$ (YES at step S2), the reattached toner pattern B shown in FIG. 6 is formed on the intermediate transfer belt 8. Therefore, immediately after the toner consumption pattern passes through the pre-cleaning nip (YES at step S3), at step S4 the control unit 112 controls the contact/separation solenoid 111 such that the first opposing roller 13 is moved to a position indicated by a broken line 13*b* in FIG. 7 to be separated from the intermediate transfer belt 8. It takes a time of (15 mm×3.14)/350 mm/sec=0.135 seconds for a portion of the first cleaning brush roller 101 that has removed the toner consumption pattern from the intermediate transfer belt 8 to make a single rotation to reach the pre-cleaning nip again. Meanwhile, it takes a time of 25 mm/350 mm/sec=0.071 seconds for the toner consumption pattern to pass through the pre-cleaning nip. Therefore, it is necessary to separate the first opposing roller 13 from the intermediate transfer belt 8 within a period of time of 0.064 seconds (0.135 sec.−0.071 sec.=0.064 sec.) after the first cleaning brush roller 101 removes the toner consumption pattern B from the intermediate transfer belt 8.

The grounded first opposing roller 13 is separated from the intermediate transfer belt 8 so that a potential difference between the intermediate transfer belt 8 and the first cleaning brush roller 101 substantially becomes zero. Accordingly, the toner positively charged at the contact portion between the first cleaning brush roller 101 and the first collection roller 102 and remaining on the first cleaning brush roller 101 to be conveyed to the pre-cleaning nip again is prevented from electrostatically moving to the intermediate transfer belt 8. Further, a width of the pre-cleaning nip is narrowed. As a result, mechanical reattachment of the toner to the intermediate transfer belt 8 when the toner contacts the intermediate transfer belt 8 can be prevented.

Accordingly, separation of the first opposing roller 13 from the intermediate transfer belt 8 can prevent formation of the reattached toner pattern B at a portion downstream from the unremoved toner consumption pattern A on the intermediate transfer belt 8 in the direction of rotation of the intermediate transfer belt 8 as illustrated in FIG. 6. Thus, the amount of reattached toner on the intermediate transfer belt 8 can be reduced. Therefore, even when the cleaning performance of the cleaning brush rollers 101, 104, and 107 is deteriorated over time, the reattached toner can be reliably removed from the intermediate transfer belt 8 by the second and third cleaning parts 100*b* and 100*c*.

When the positively-charged toner on the first cleaning brush roller 101 is conveyed to the first collection roller 102 again, the voltage applied to the first collection roller 102 is reduced to make it smaller than the voltage applied to the first cleaning brush roller 101. As a result, the positively-charged toner on the first cleaning brush roller 101 is electrostatically moved to the first collection roller 102 to be collected from the first cleaning brush roller 101.

Then, after a predetermined period of time elapses (YES at step S5), at step S6 the contact/separation solenoid 111 is turned off so that the first opposing roller 13 is moved to a position indicated by a solid line 13*a* in FIG. 7 to contact the intermediate transfer belt 8 before the next image formation range (or the next residual toner) on the intermediate transfer belt 8 is conveyed to the first cleaning brush roller 101. Specifically, the first opposing roller 13 is separated from the intermediate transfer belt 8 during a period of time equal to or longer than a period of time when the portion of the first cleaning brush roller 101 that removes the toner consumption pattern passes through the pre-cleaning nip. In the first illustrative embodiment, it is preferable that the first opposing roller 13 be separated from the intermediate transfer belt 8 for 0.071 seconds or longer.

The voltage applied to the first collection roller 102 is returned to V1 at a predetermined timing. A voltage V2 is applied to the first collection roller 102 during a period of time equal to or longer than a period of time while the portion of the first cleaning brush roller 101 that has removed the toner consumption pattern passes through the first collection roller 102 again. In other words, the voltage V2 is applied to the first collection roller 102 for 0.071 seconds or longer.

In the first illustrative embodiment, the first opposing roller 13 contacts the intermediate transfer belt 8 before the residual toner is conveyed to the belt cleaning device 100 to remove the residual toner from the intermediate transfer belt 8 by the first cleaning brush roller 101. However, the configuration of the belt cleaning device 100 is not limited thereto. Alternatively, for example, the first opposing roller 13 contacts the intermediate transfer belt 8 when the untransferred toner image such as the graduation patterns S, the chevron patch PV, or the toner consumption pattern is conveyed to the belt cleaning device 100 so as to remove much of the untransferred toner image from the intermediate transfer belt 8 using the first cleaning brush roller 101. By contrast, when the residual toner is conveyed to the belt cleaning device 100, the first opposing roller 13 is separated from the intermediate transfer belt 8 so that the residual toner is not removed from the intermediate transfer belt 8 by the first cleaning brush roller 101. Because an amount of the residual toner is smaller, the second and third cleaning parts 100*b* and 100*c* can reliably remove the residual toner from the intermediate transfer belt 8. However, an amount of toner in the untransferred toner image such as the chevron patch PV or the toner consumption pattern is larger. Therefore, the first opposing roller 13 contacts the intermediate transfer belt 8 to remove much of the untransferred toner image from the intermediate transfer belt 8 using the first cleaning brush roller 101. As a result, product life of the first cleaning part 100*a* can be extended.

A description is now given of a second illustrative embodiment of the present invention.

In the second illustrative embodiment, a voltage of 0 V is applied to the first cleaning brush roller 101 in order to prevent the positively-charged toner on the first cleaning brush roller 101 from reattaching to the intermediate transfer belt 8.

Figure 10:
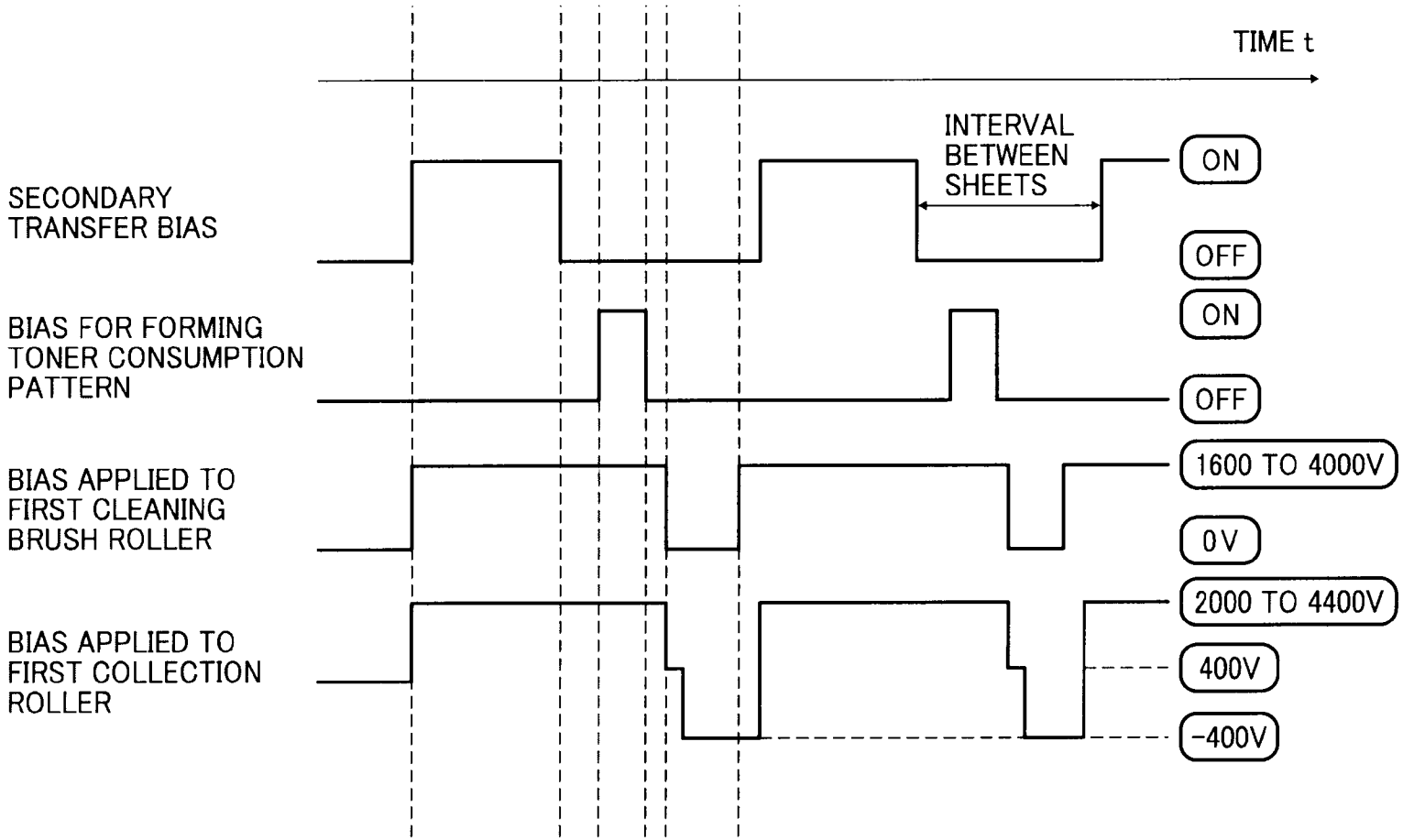
FIG. 10 is a timing chart illustrating application of voltages according to a second illustrative embodiment.
Figure 11:
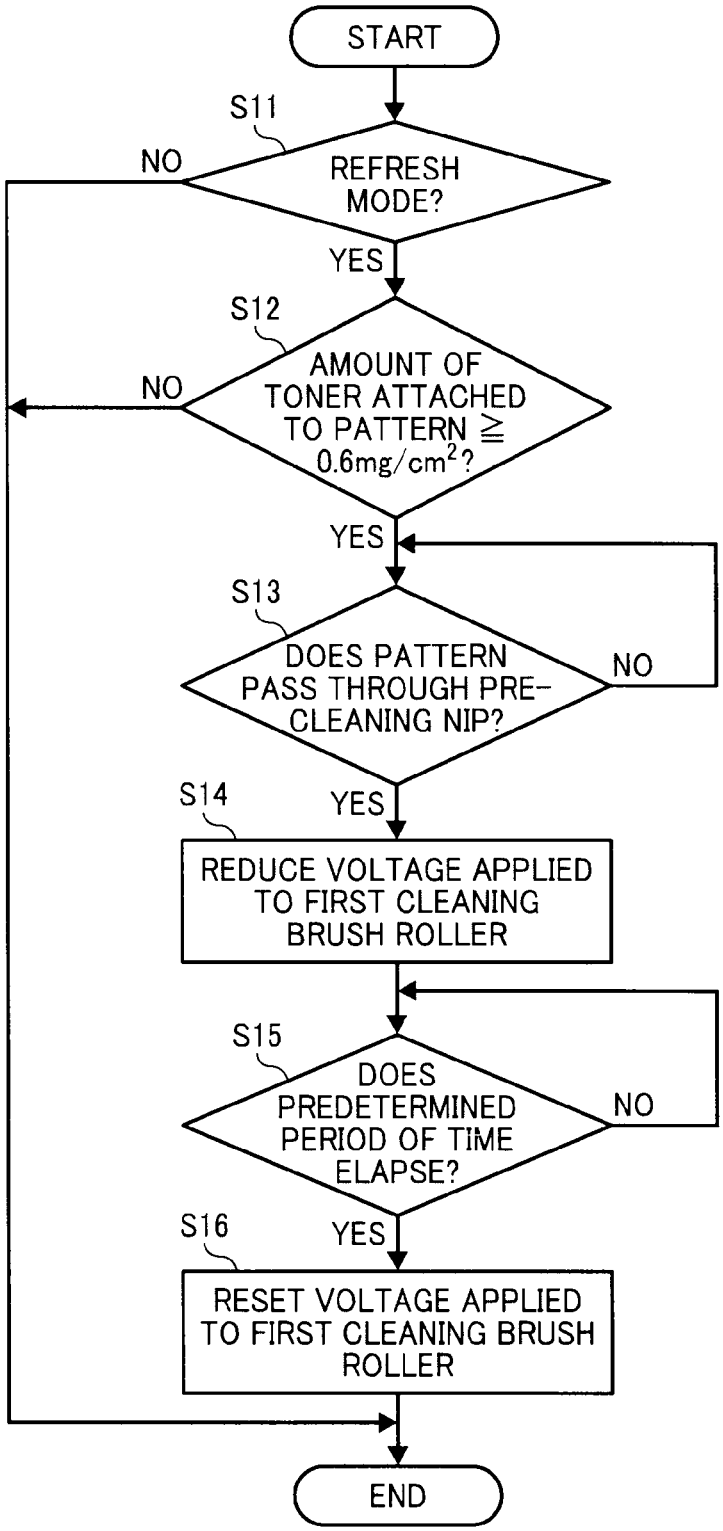
FIG. 11 is a flowchart illustrating steps in a process of operation of the belt cleaning device according to the second illustrative embodiment.

FIG. 10 is a timing chart illustrating application of voltages according to the second illustrative embodiment. FIG. 11 is a flowchart illustrating steps in a process of operation of the belt cleaning device 100 according to the second illustrative embodiment.

When the image forming apparatus 50 is moved to the refresh mode (YES at step S11), the process proceeds to step S12 so that the control unit 112 checks whether or not a toner amount in a toner consumption pattern is equal to or greater than 0.6 mg/cm$^2$. When the toner amount in the toner consumption pattern is equal to or greater than 0.6 mg/cm$^2$ (YES at step S12), the process proceeds to step S13 to determine whether or not the toner consumption pattern has passed through the pre-cleaning nip. When the toner consumption pattern has passed through the pre-cleaning nip (YES at step S13), the process proceeds to step S14 so that a voltage applied to the first cleaning brush roller 101 is reduced within 0.064 seconds after the toner consumption pattern has passed through the pre-cleaning nip. In the second illustrative embodiment, a voltage of 0 V is applied to the first cleaning brush roller 101 as shown in FIG. 10. In synchronization with reduction of the voltage applied to the first cleaning brush roller 101 to 0 V, the voltage applied to the first collection roller 102 is reduced to 400 V.

Accordingly, a potential difference between the intermediate transfer belt 8 and the first cleaning brush roller 101 becomes 0 V. As a result, the toner on the first cleaning brush roller 101 which is positively charged at the contact portion between the first cleaning brush roller 101 and the first collection roller 102 is not electrostatically moved to the intermediate transfer belt 8. Thus, as illustrated in FIG. 6, formation of the reattached toner pattern B at a portion downstream from the unremoved toner consumption pattern A on the intermediate transfer belt 8 in the direction of rotation of the intermediate transfer belt 8 can be prevented. Accordingly, the amount of reattached toner on the intermediate transfer belt 8 can be reduced. Therefore, even when the cleaning performance of the cleaning brush rollers 101, 104, and 107 deteriorates over time, the reduced amount of reattached toner can be reliably removed from the intermediate transfer belt 8 by the second and third cleaning parts 100*b* and 100*c*.

When the positively-charged toner on the first cleaning brush roller 101 is conveyed to the first collection roller 102 again, the voltage applied to the first collection roller 102 is reduced to −400 V to make it smaller than the voltage applied to the first cleaning brush roller 101. As a result, the positively-charged toner on the first cleaning brush roller 101 is electrostatically moved to the first collection roller 102 to be collected from the first cleaning brush roller 101.

Then, after a predetermined period of time elapses (YES at step S15), at step S16 the voltages respectively applied to the first cleaning brush roller 101 and the first collection roller 102 are reset before the next image formation range (or the next residual toner) on the intermediate transfer belt 8 is conveyed to the first cleaning brush roller 101.

Alternatively, the voltage applied to the first cleaning brush roller 101 may be changed based on an amount of toner conveyed to the pre-cleaning nip.

Figure 12:
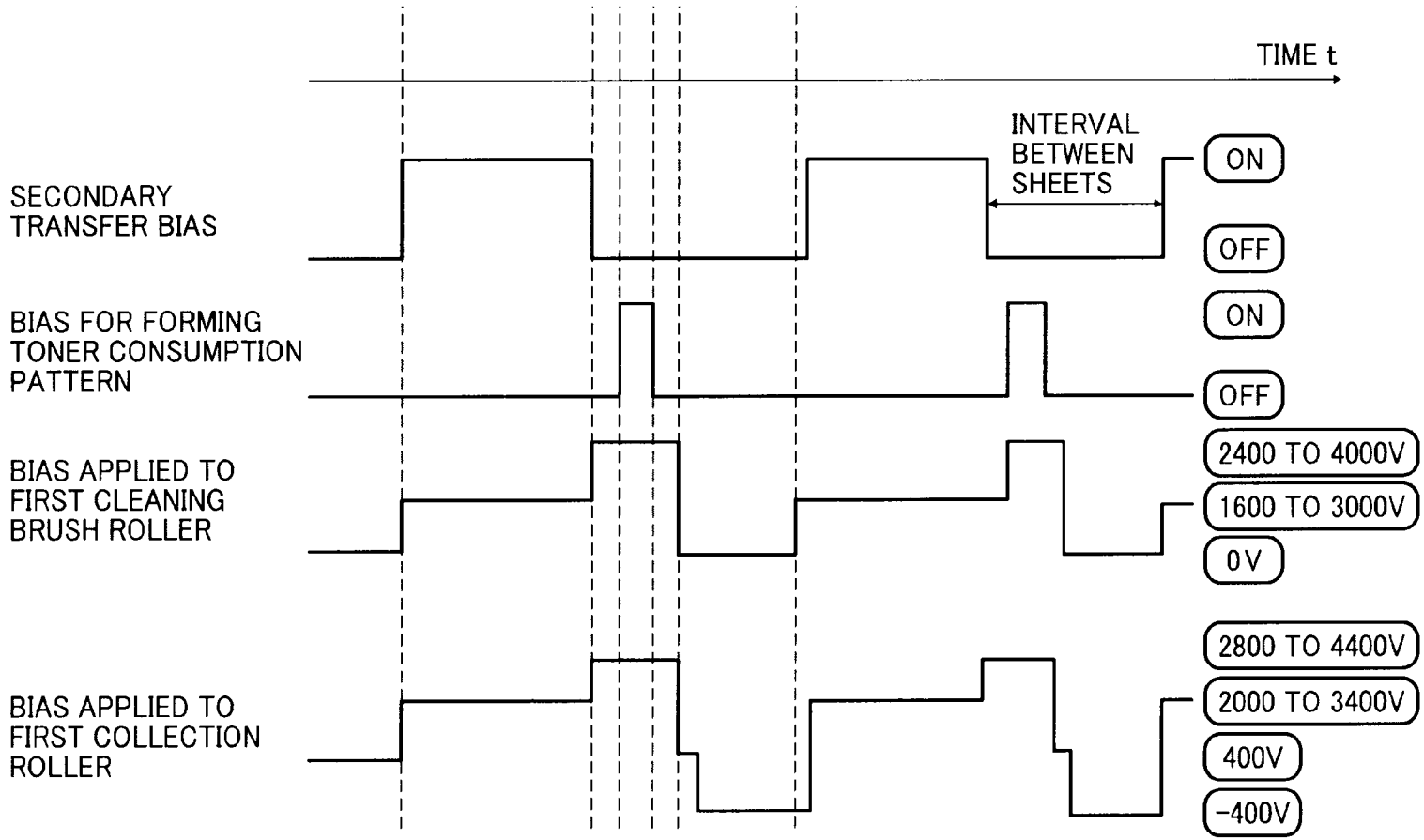
FIG. 12 is a timing chart illustrating application of voltages according to a first variation of the second illustrative embodiment.

FIG. 12 is a timing chart illustrating application of the voltages according to a first variation of the second illustrative embodiment.

When a smaller amount of residual toner is conveyed to the pre-cleaning nip, the voltage applied to the first cleaning brush roller 101 is set to a range of from 1,600 V to 3,000 V. By contrast, when the toner consumption pattern having the larger amount of toner is conveyed to the pre-cleaning nip, the voltage applied to the first cleaning brush roller 101 is controlled to be in a range of from 2,400 V to 4,000 V. The voltage applied to the first collection roller 102 is also controlled such that a potential difference of 400 V is kept between the first cleaning brush roller 101 and the first collection roller 102. For example, a voltage of 2,000 V is applied to the first cleaning brush roller 101 in order to remove the residual toner, while a voltage of 2,600 V is applied to the first cleaning brush roller 101 in order to remove the toner consumption pattern from the intermediate transfer belt 8.

Because the amount of the residual toner is smaller, the second and third cleaning parts 100*b* and 100*c* can reliably remove the residual toner from the intermediate transfer belt 8. Therefore, alternatively, the voltage of 0 V may be applied to the first cleaning brush roller 101 when the residual toner is conveyed to the first cleaning brush roller 101 so that the residual toner is not removed from the intermediate transfer belt 8 by the first cleaning brush roller 101. By contrast, a voltage in a range of from 1,600 V to 4,000 V may be applied to the first cleaning brush roller 101 when the untransferred toner image such as the graduation patterns S, the chevron patch PV, or the toner consumption pattern is conveyed to the first cleaning brush roller 101 so as to remove much of the untransferred toner image by the first cleaning brush roller 101. As a result, product life of the first cleaning part 100*a* can be extended.

Figure 13:
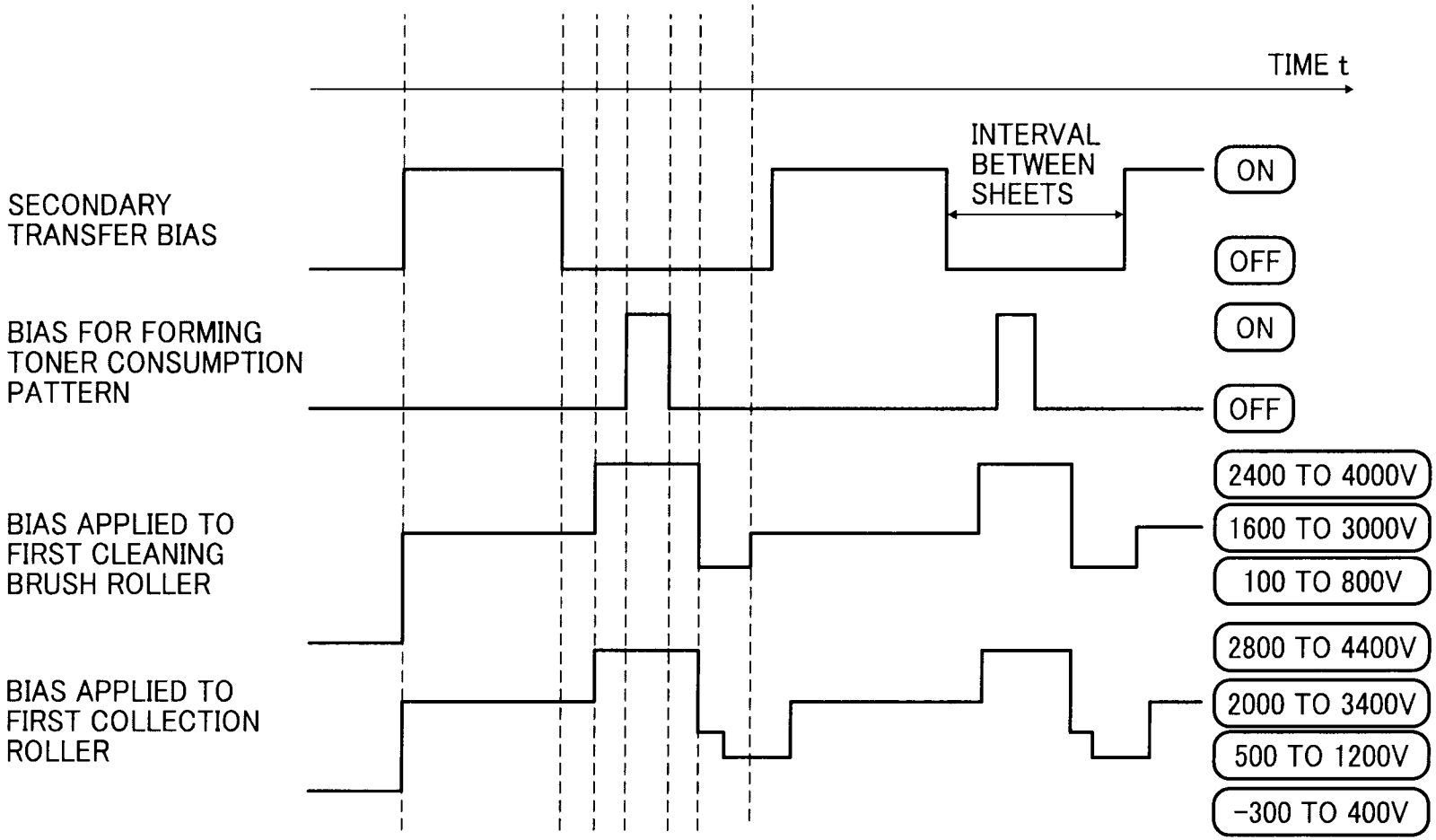
FIG. 13 is a timing chart illustrating application of voltages according to a second variation of the second illustrative embodiment.

FIG. 13 is a timing chart illustrating application of the voltages according to a second variation of the second illustrative embodiment.

In the second variation of the second illustrative embodiment, a voltage in a range of from 100 V to 800 V is applied to the first cleaning brush roller 101 immediately after the untransferred toner image passes through the pre-cleaning nip. Although application of the voltage in the range of from 100 V to 800 V to the first cleaning brush roller 101 increases an amount of reattached toner compared to a case in which the voltage of 0 V is applied to the first cleaning brush roller 101, the amount of reattached toner is not enough to form the reattached toner pattern B shown in FIG. 6. Therefore, even when the voltage in the range of from 100 V to 800 V is applied to the first cleaning brush roller 101, the reattached toner can be reliably removed by the second cleaning brush roller 104 over time. In addition, the voltage applied to the first collection roller 102 can be made smaller than the voltage applied to the first cleaning brush roller 101 without applying a negative voltage to the first collection roller 102. Accordingly, the positively-charged toner is removed from the first cleaning brush roller 101 by the first collection roller 102. As a result, it is not necessary to provide a power source that applies the negative voltage to the first collection roller 102, thereby reducing production costs.

Not only the positively-charged toner but also the negatively-charged toner remains on the first cleaning brush roller 101 without being collected by the first collection roller 102. A voltage in a range of from 100 V to 800 V is applied to the first cleaning brush roller 101 so as to form a potential difference between the intermediate transfer belt 8 and the first cleaning brush roller 101 even after the consumption toner pattern is removed from the intermediate transfer belt 8. Accordingly, the negatively-charged toner on the first cleaning brush roller 101 conveyed to the pre-cleaning nip again without being collected to the first collection roller 102 is prevented from electrostatically reattaching to the intermediate transfer belt 8. Thus, the amount of reattached toner on the intermediate transfer belt 8 can be reduced.

Figure 14:
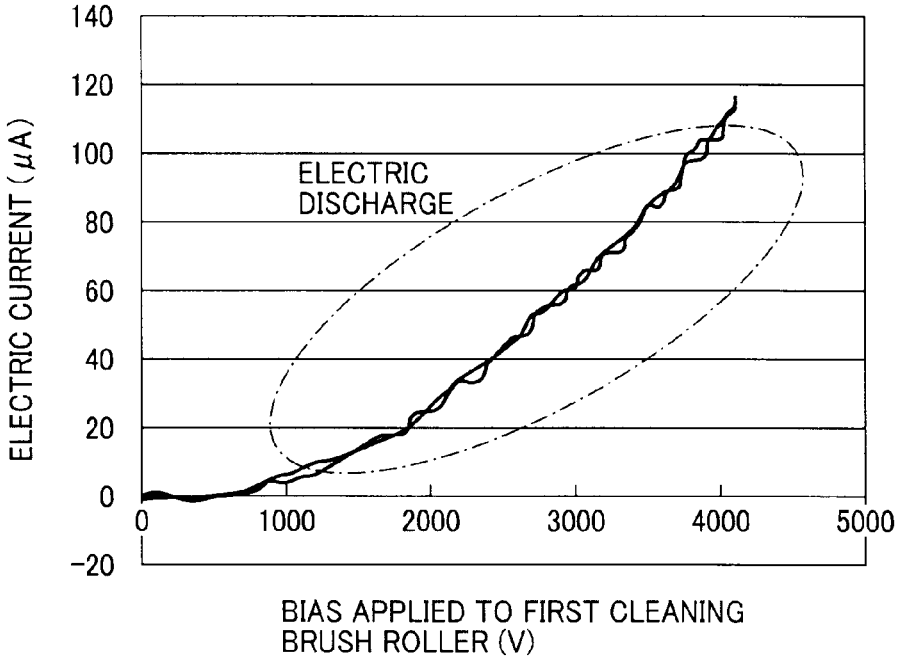
FIG. 14 is a graph showing relations between an amount of electric current flowing between the first cleaning brush roller and the intermediate transfer belt and a voltage applied to the first cleaning brush roller.

FIG. 14 is a graph showing an amount of electric current flowing between the first cleaning brush roller 101 and the intermediate transfer belt 8 when the voltage applied to the first cleaning brush roller 101 is changed during rotation of the intermediate transfer belt 8.

It is considered that electric discharge occurs when a voltage of 1,000 V or larger is applied to the first cleaning brush roller 101. No electric discharge occurs when a voltage in a range of from 100 V to 800 V is applied to the first cleaning brush roller 101. Therefore, application of the voltage in the range of from 100 V to 800 V to the first cleaning brush roller 101 can prevent the negatively-charged uncollected toner on the first cleaning brush roller 101 from being positively charged due to electric discharge occurring between the first cleaning brush roller 101 and the intermediate transfer belt 8 or between the first cleaning brush roller 101 and the toner. Accordingly, the uncollected toner on the first cleaning brush roller 101 is not electrostatically moved to the intermediate transfer belt 8. Thus, the amount of reattached toner on the intermediate transfer belt 8 can be reduced. As a result, the reduced amount of reattached toner can be reliably removed from the intermediate transfer belt 8 by the second and third cleaning parts 100*b* and 100*c*.

Figure 15:
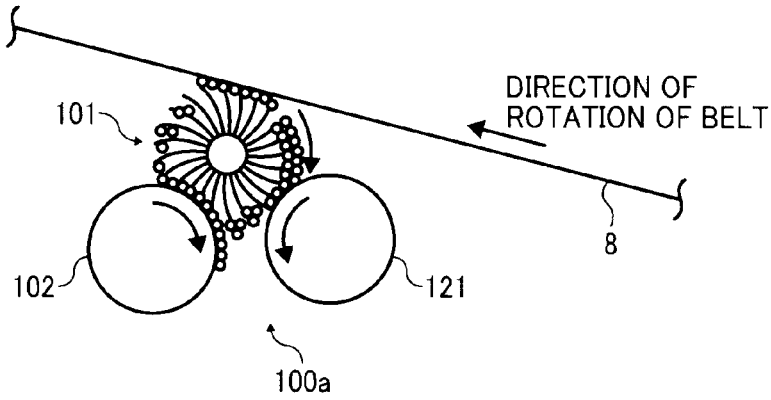
FIG. 15 is a schematic view illustrating a configuration of a first cleaning unit according to a variation.

A description is now given of a configuration of the first cleaning unit 100*a* according to a variation of the foregoing illustrative embodiments with reference to FIG. 15.

The first cleaning part 100*a* according to the variation further includes a charging member 121 at a portion from the pre-cleaning nip to the contact portion between the first cleaning brush roller 101 and the first collection roller 102 in the direction of rotation of the first cleaning brush roller 101. The charging member 121 negatively charges the toner attaching to the first cleaning brush roller 101.

The charging member 121 is constructed of an aluminum roller having a diameter of ϕ10 mm and a coating layer including siloxane provided on the surface of the aluminum roller. The charging member 121 is rotated in a counterclockwise direction in FIG. 15 and is electrically floated. A material that negatively charges the toner is used for the charging member 121. When the toner is composed of polyester, a material that has more positive charges than polyester in the triboelectric series is used for the charging member 121. For example, a surface of a metal roller of the charging member 121 may be coated with a layer of alkoxy siloxane (A), aminosilane coupling agent (B), and silicone resin, or a nylon tube. Alternatively, the charging member 121 may be constructed of an SUS roller, the surface of which is plated with titanium.

The negatively-charged toner attached to the first cleaning brush roller 101 from the intermediate transfer belt 8 is further negatively charged triboelectrically by the charging member 121, and then passes through the contact portion between the first cleaning brush roller 101 and the first collection roller 102. Accordingly, the negatively-charged toner on the first cleaning brush roller 101 is prevented from being positively charged even when positive electric charges are injected into the negatively-charged toner on the first cleaning brush roller 101. As a result, the amount of toner conveyed to the pre-cleaning nip again without being collected by the first collection roller 102 can be reduced. Thus, the amount of toner reattached to the intermediate transfer belt 8 can be reduced. Therefore, a threshold of the amount of toner in the toner consumption pattern for separating the first opposing roller 13 from the intermediate transfer belt 8 or reducing the voltage applied to the first cleaning brush roller 101 can be increased.

In addition, the polarity of the toner on the first cleaning brush roller 101, which is positively charged at the contact portion between the first cleaning brush roller 101 and the first collection roller 102, can be reversed to the negative polarity by contacting the charging member 121. As a result, the uncollected toner on the first cleaning brush roller 101 can be collected by the first collection roller 102 without making the voltage applied to the first collection roller 102 smaller than the voltage applied to the first cleaning brush roller 101.

To make the positively-charged uncollected toner contact the charging member 121 to reverse the polarity thereof, it is necessary to set an amount of engagement of the charging member 121 with the first cleaning brush roller 101 equal to or greater than an amount of engagement of the first collection roller 102 with the first cleaning brush roller 101. The toner on the first cleaning brush roller 101, which is positively charged at the contact portion between the first cleaning brush roller 101 and the first collection roller 102, is moved from one fiber of the first cleaning brush roller 101 to the next fiber thereof at the contact portion by rotation of the first collection roller 102. Because each of the fibers is bent corresponding to the amount of engagement with the first collection roller 102, specifically, the positively-charged toner is attached to the next fiber at a portion inside from the leading edge thereof corresponding to the amount of engagement with the first collection roller 102. Consequently, most of the uncollected toner is attached to the fibers of the first cleaning brush rollers 101 at the portions inside from the leading edges thereof corresponding to the amount of engagement with the first collection roller 102. Therefore, the charging member 121 can reliably contact the positively-charged toner attached to the inner portions of the fibers by setting the amount of engagement of the charging member 121 with the first cleaning brush roller 101 to be equal to or greater than the amount of engagement of the first collection roller 102 with the first cleaning brush roller 101, thereby optimally reversing the polarity of the positively-charged toner.

For example, when the amount of engagement of the first collection roller 102 with the first cleaning brush roller 101 is 1 mm, the positively-charged toner is attached to the fibers of the first cleaning brush roller 101 at portions 1 mm inside from the leading edges thereof. Thus, in order to reverse the polarity of the positively-charged toner attached to the first cleaning brush roller 101, it is necessary to set the amount of engagement of the charging member 121 with the first cleaning brush roller 101 equal to or greater than the amount of engagement of the first collection roller 102 with the first cleaning brush roller 101.

Further, it is preferable that the charging member 121 be rotated faster than the first cleaning brush roller 101.

Figure 16A:
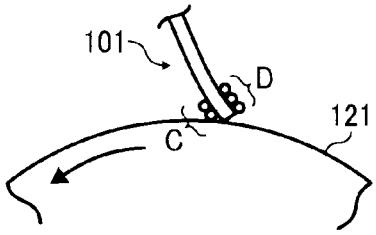
FIGS. 16A and 16B are enlarged views respectively illustrating a contact portion between the first cleaning brush roller and a charging member in the first cleaning unit illustrated in FIG. 15.
Figure 16B:
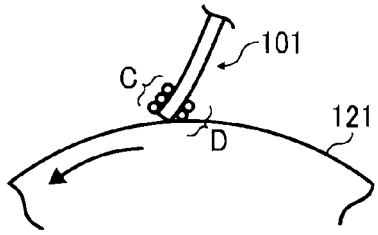

FIG. 16A is an enlarged schematic view illustrating a state immediately after the fiber of the first cleaning brush roller 101 enters a contact portion with the charging member 121. FIG. 16B is an enlarged schematic view illustrating a state after the fiber is moved to a predetermined distance within the contact portion.

As illustrated in FIG. 16A, the leading edge of the fiber immediately after entering the contact portion with the charging member 121 is bent to the downstream side in the direction of rotation of the first cleaning brush roller 101. Therefore, an upstream portion C of the fiber contacts the surface of the charging member 121 immediately after the fiber enters the contact portion. As a result, the toner attached to the upstream portion C of the fiber is charged triboelectrically by the charging member 121. When the fiber is moved to the predetermined distance within the contact portion with the charging member 121, the leading edge of the fiber is bent toward the upstream side as illustrated in FIG. 16B due to the rotary speed of the charging member 121 being faster than that of the fiber (or the first cleaning brush roller 101). As a result, a downstream portion D of the fiber contacts the surface of the charging member 121 as illustrated in FIG. 16B. Thus, the toner attached to the downstream portion D of the fiber is charged triboelectrically by the charging member 121. Therefore, the toner attached to the fiber is sufficiently charged by the charging member 121, thereby improving a collection efficiency of the toner to the first collection roller 102.

Alternatively, the charging member 121 may also be provided to the second or third cleaning part 100*b* or 100*c*. The same material used for the charging member 121 provided to the first cleaning part 100*a* may be used for the charging member 121 provided to the third cleaning part 100*c* so as to negatively charge the toner on the third cleaning brush roller 107. By contrast, a material that positively charges the toner is used for the charging member 121 provided to the second cleaning part 100*b* so as to positively charge the toner on the second cleaning brush roller 104. When the toner is composed of polyester, a material that has more negative charges than polyester in the triboelectric series is used for the charging member 121 provided to the second cleaning part 100*b*. For example, the charging member 121 may be coated with PVDF, Teflon®, or fluorinated resin.

Provision of the charging member 121 to the second or third cleaning part 100*b* or 100*c* increases the collection efficiency of the toner to the second or third collection rollers 105 or 108, thereby preventing uncollected toner.

Alternatively, a charger constructed of a polarity member and a power source may be used as the charging member 121 so as to inject charges to the toner attached to the cleaning brush roller 101, 104, or 107.

As described above, the negative charges are injected into the toner on the intermediate transfer belt 8 by the second cleaning brush roller 104 so as to give the toner conveyed to the third cleaning brush roller 107 a negative polarity. However, such polarity control need not necessarily be performed depending on toner conditions and image forming conditions. In addition, in place of the third cleaning part 100*c*, the second cleaning part 100*b* may be provided on the extreme downstream end. In such a case, polarity control in which positive charges are injected into the toner on the intermediate transfer belt 8 by the third cleaning brush roller 107 so as to give the toner to be conveyed to the second cleaning brush roller 104 a positive polarity may or may not be performed depending on toner conditions and image forming conditions.

As described above, in a case in which the toner is not given the negative polarity or is given the positive polarity, the reattached toner is removed by the second cleaning brush roller 104. However, when the toner consumption pattern having the toner amount of 0.6 mg/cm$^2$ is removed by the first cleaning brush roller 101, the first opposing roller 13 is separated from the intermediate transfer belt 8, or the voltage applied to the first cleaning brush roller 101 is reduced, immediately after the toner consumption pattern passes through the pre-cleaning nip, thereby reducing the amount of toner reattached to the intermediate transfer belt 8. Therefore, the reduced amount of reattached toner can be reliably removed from the intermediate transfer belt 8 even when the fibers of the second cleaning brush roller 104 are narrowed over time and the cleaning performance of the second cleaning brush roller 104 deteriorates.

Although the positively-charged toner on the intermediate transfer belt 8 is removed by the second cleaning brush roller 104 in the belt cleaning device 100, alternatively, a polarity controller may be used in place of the second cleaning part 100*b* so as not to remove the positively-charged toner from the intermediate transfer belt 8. In such a case, the toner on the intermediate transfer belt 8 passing through the first cleaning brush roller 101 is given a negative polarity by the polarity controller, and is further conveyed to the third cleaning brush roller 107 provided downstream from the polarity controller. Thus, the negatively-charged toner is removed by the third cleaning brush roller 107. In the polarity controller, negative charges are injected into the toner on the intermediate transfer belt 8 by, for example, a conductive brush, a conductive blade, or the like. Further alternatively, the toner on the intermediate transfer belt 8 may be given the positive polarity so as to be removed by a cleaning brush roller, to which a negative voltage is applied, provided downstream from the polarity controller in the direction of rotation of the intermediate transfer belt 8. In such a case, much of the toner in the untransferred toner image is removed from the intermediate transfer belt 8 by the first cleaning brush roller 101 so that the amount of toner conveyed to the polarity controller is reduced. Therefore, the toner on the intermediate transfer belt 8 can be reliably given the same polarity by the polarity controller. Accordingly, the toner is electrostatically removed from the intermediate transfer belt 8 by the cleaning brush roller provided downstream from the polarity controller. Thus, the untransferred toner image having the larger amount of toner can be reliably removed by the belt cleaning device 100.

In the belt cleaning device 100, a voltage is applied to each of the collection rollers 102, 105, and 108 and the cleaning brush rollers 101, 104, and 107. Alternatively, each of the collection rollers 102, 105, and 108 may include a metal roller and a voltage applied only to the collection rollers 102, 105, and 108. In such a case, a voltage slightly smaller than the voltage applied to the collection rollers 102, 105, and 108 is applied to each of the cleaning brush rollers 101, 104, and 107 through the contact portions between the collection rollers 102, 105, and 108 and the cleaning brush rollers 101, 104, and 107, due to a potential decrease caused by resistance of the fibers in the cleaning brush rollers 101, 104, and 107. Accordingly, a potential difference is formed between the collection rollers 102, 105, and 108 and the cleaning brush rollers 101, 104, and 107, respectively. As a result, the toner is electrostatically moved from the cleaning brush rollers 101, 104, and 107 to the collection rollers 102, 105, and 108 using a potential gradient.

A description is now given of toner used in the image forming apparatus 50 according to illustrative embodiments.

In order to satisfy increasing demand for higher quality images, a volume average particle diameter (Dv) of the toner is preferably in a range of from 3 μm to 6 μm to reproduce microdots not less than 600 dpi. A ratio (Dv/Dn) of the volume average particle diameter (Dv) to the number average particle diameter (Dn) of the toner is preferably in a range of from 1.00 to 1.40. As the ratio (Dv/Dn) approaches 1, the particle diameter distribution becomes narrower. The toner having a smaller particle diameter and a narrower particle diameter distribution can be uniformly charged and transferred, and therefore high quality images without background fogging can be produced, and a higher transfer rate can be achieved in the image forming apparatus 50 employing the electrostatic transfer system.

Figure 17:
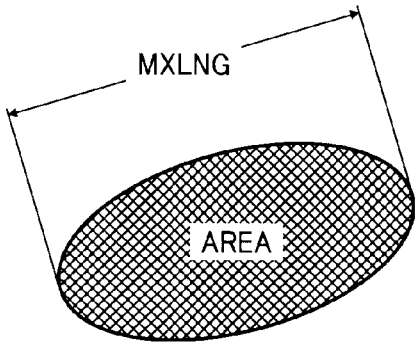
FIG. 17 is a schematic view illustrating a shape of a toner particle for explaining shape factor SF-1.

The toner having high circularity with a shape factor SF-1 of from 100 to 180 and a shape factor SF-2 of from 100 to 180 is used in the image forming apparatus 50 according to illustrative embodiments. FIG. 17 is a schematic view illustrating a shape of toner for explaining the shape factor SF-1. As illustrated in FIG. 17, the shape factor SF-1 represents a degree of roundness of a toner particle, and is determined in accordance with the following formula (1). The shape factor SF-1 is obtained by dividing the square of the maximum length MXLNG of the shape produced by projecting the toner particle in a two-dimensional plane, by the figural surface area AREA, and subsequently multiplying by 100π/4.

$$\text{SF-1}=\{(MXLNG)^2/\text{AREA}\}\times(100\pi/4) \quad (1)$$

When SF-1 is 100, the toner particle has a shape of a complete sphere. As SF-1 becomes greater, the toner particle becomes more amorphous.

Figure 18:
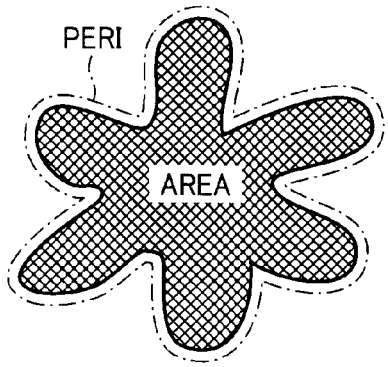
FIG. 18 is a schematic view illustrating a shape of a toner particle for explaining shape factor SF-2.

FIG. 18 is a schematic view illustrating a shape of toner for explaining the shape factor SF-2. As illustrated in FIG. 18, the shape factor SF-2 represents a concavity and convexity of the shape of the toner particle, and is determined in accordance with the following formula (2). The shape factor SF-2 is obtained by dividing the square of the perimeter PERI of the figure produced by projecting the toner particle in a two-dimensional plane, by the figural surface area AREA, and subsequently multiplying by 100π/4.

$$SF\text{-}2=\{(PELI)^2/AREA\}\times(100\pi/4) \quad (2)$$

When SF-2 is 100, the surface of the toner particle has no concavities and convexities. As SF-2 becomes greater, the concavities and convexities thereon become more noticeable.

The shape factors can be measured by taking a picture of the toner particle with a scanning electron microscope S-800 manufactured by Hitachi, Ltd., and analyzing the picture with an image analyzer LUSEX 3 manufactured by Nireco Corporation to calculate the shape factors. When a shape of the toner particle becomes close to a sphere, toner particles contact each other as well as the photoconductors 1 in a point contact manner. Consequently, absorbability between the toner particles decreases, resulting in an increase in fluidity. Moreover, absorbability between the toner particles and the photoconductors 1 decreases, resulting in an increase in a transfer rate. When either the shape factor SF-1 or SF-2 is too large, the transfer rate deteriorates.

The toner preferably used for image formation performed by the image forming apparatus 50 is obtained by a crosslinking reaction and/or an elongation reaction of a toner constituent liquid in an aqueous solvent. Here, the toner constituent liquid is prepared by dispersing a polyester prepolymer including a functional group having at least a nitrogen atom, a polyester, a colorant, and a releasing agent in an organic solvent. A description is now given of toner constituents and a method for manufacturing toner.

(Polyester)

The polyester is prepared by a polycondensation reaction between a polyalcohol compound and a polycarboxylic acid compound.

Specific examples of the polyalcohol compound (PO) include a diol (DIO) and a polyol having 3 or more valances (TO). The DIO alone, and a mixture of the DIO and a smaller amount of the TO are preferably used as the PO. Specific examples of the diol (DIO) include alkylene glycols (e.g., ethylene glycol, 1,2-propylene glycol, 1,3-propylene glycol, 1,4-butanediol, and 1,6-hexanediol), alkylene ether glycols (e.g., diethylene glycol, triethylene glycol, dipropyrene glycol, polyethylene glycol, polypropylene glycol, and polytetramethylene ether glycol), alicyclic diols (e.g., 1,4-cyclohexane dimethanol, and hydrogenated bisphenol A), bisphenols (e.g., bisphenol A, bisphenol F, and bisphenol S), alkylene oxide adducts of the above-described alicyclic diols (e.g., ethylene oxide, propylene oxide, and butylene oxide), and alkylene oxide adducts of the above-described bisphenols (e.g., ethylene oxide, propylene oxide, and butylene oxide). Among the above-described examples, alkylene glycols having 2 to 12 carbon atoms and alkylene oxide adducts of bisphenols are preferably used. More preferably, the alkylene glycols having 2 to 12 carbon atoms and the alkylene oxide adducts of bisphenols are used together. Specific examples of the polyol having 3 or more valances (TO) include aliphatic polyols having 3 to 8 or more valances (e.g., glycerin, trimethylolethane, trimethylol propane, pentaerythritol, and sorbitol), phenols having 3 or more valances (e.g., trisphenol PA, phenol novolac, and cresol novolac), and alkylene oxide adducts of polyphenols having 3 or more valances.

Specific examples of the polycarboxylic acids (PC) include dicarboxylic acids (DIC) and polycarboxylic acids having 3 or more valances (TC). The DIC alone, and a mixture of the DIC and a smaller amount of the TC are preferably used as the PC. Specific examples of the dicarboxylic acids (DIC) include alkylene dicarboxylic acids (e.g., succinic acid, adipic acid, and sebacic acid), alkenylene dicarboxylic acids (e.g., maleic acid and fumaric acid), and aromatic dicarboxylic acids (e.g., phthalic acid, isophthalic acid, terephthalic acid, and naphthalene dicarboxylic acid). Among the above-described examples, alkenylene dicarboxylic acids having 4 to 20 carbon atoms and aromatic dicarboxylic acids having 8 to 20 carbon atoms are preferably used. Specific examples of the polycarboxylic acids having 3 or more valances (TC) include aromatic polycarboxylic acids having 9 to 20 carbon atoms (e.g., trimellitic acid and pyromellitic acid). The polycarboxylic acid (PC) may be reacted with the polyol (PO) using acid anhydrides or lower alkyl esters (e.g., methyl ester, ethyl ester, and isopropyl ester) of the above-described materials.

A ratio of the polyol (PO) and the polycarboxylic acid (PC) is normally set in a range of from 2/1 to 1/1, preferably from 1.5/1 to 1/1, and more preferably from 1.3/1 to 1.02/1 as an equivalent ratio [OH]/[COOH] between a hydroxyl group [OH] and a carboxyl group [COOH]. The polycondensation reaction between the polyol (PO) and the polycarboxylic acid (PC) is carried out by heating the PO and the PC to from 150° C. to 280° C. in the presence of a known catalyst for esterification such as tetrabutoxy titanate and dibutyltin oxide and removing produced water under a reduced pressure as necessary to obtain a polyester having hydroxyl groups. The polyester preferably has a hydroxyl value not less than 5, and an acid value of from 1 to 30, and preferably from 5 to 20. When the polyester has the acid value within the range, the resultant toner tends to be negatively charged to have good affinity with the transfer member, and lower-temperature fixability of the toner on the transfer member improves. However, when the acid value is too large, the resultant toner is not stably charged and the stability becomes worse by environmental variations. The polyester preferably has a weight-average molecular weight of from 10,000 to 400,000, and more preferably from 20,000 to 200,000. When the weight-average molecular weight is too small, offset resistance of the resultant toner deteriorates. By contrast, when the weight-average molecular weight is too large, lower-temperature fixability thereof deteriorates.

The polyester preferably includes a urea-modified polyester as well as an unmodified polyester obtained by the above-described polycondensation reaction. The urea-modified polyester is prepared by reacting a polyisocyanate compound (PIC) with a carboxyl group or a hydroxyl group at the end of the polyester obtained by the above-described polycondensation reaction to form a polyester prepolymer (A) having an isocyanate group, and reacting amine with the polyester prepolymer (A) to crosslink and/or elongate a molecular chain thereof. Specific examples of the polyisocyanate compound (PIC) include aliphatic polyisocyanates (e.g., tetramethylene diisocyanate, hexamethylene diisocyanate, and 2,6-diisocyanate methylcaproate), alicyclic polyisocyanates (e.g., isophoron diisocyanate and cyclohexyl methane diisocyanate), aromatic diisocyanates (e.g., trilene diisocyanate and diphenylmethane diisocyanate), aromatic aliphatic diisocyanates (e.g., α,α,α',α'-tetramethyl xylylene diisocyanate), isocyanurates, materials blocked against the polyisocyanate with phenol derivatives, oxime, caprolactam or the like, and combinations of two or more of the above-described materials. The PIC is mixed with the polyester such that an equivalent ratio [NCO]/[OH] between an isocyanate group [NCO] in the PIC and a hydroxyl group [OH] in the polyester is typically in a range of from 5/1 to 1/1, preferably from 4/1 to 1.2/1, and more preferably from 2.5/1 to 1.5/1. When [NCO]/[OH] is too large, lower-temperature fixability of the resultant toner deteriorates. When [NCO]/[OH] is too small, a urea content in ester of the modified polyester decreases and hot offset resistance of the resultant toner deteriorates. The polyester prepolymer (A) typically includes a polyisocyanate group of from 0.5 to 40% by weight, preferably from 1 to 30% by weight, and more preferably from 2 to 20% by weight. When the content is too small, hot offset resistance of the resultant toner deteriorates, and in addition, the heat resistance and lower-temperature fixability of the toner also deteriorate. By contrast, when the content is too large, lower-temperature fixability of the resultant toner deteriorates. The number of the isocyanate groups included in a molecule of the polyester prepolymer (A) is at least 1, preferably from 1.5 to 3 on average, and more preferably from 1.8 to 2.5 on average. When the number of the isocyanate group is too small per 1 molecule, the molecular weight of the urea-modified polyester decreases and hot offset resistance of the resultant toner deteriorates.

Specific examples of amines (B) reacted with the polyester prepolymer (A) include diamines (B1), polyamines (B2) having 3 or more amino groups, amino alcohols (B3), amino mercaptans (B4), amino acids (B5), and blocked amines (B6) in which the amines (B1 to B5) described above are blocked.

Specific examples of the diamines (B1) include aromatic diamines (e.g., phenylene diamine, diethyltoluene diamine, and 4,4'-diaminodiphenyl methane), alicyclic diamines (e.g., 4,4'-diamino-3,3'-dimethyldicyclohexylmethane, diamine cyclohexane, and isophoron diamine), and aliphatic diamines (e.g., ethylene diamine, tetramethylene diamine, and hexamethylene diamine). Specific examples of the polyamines (B2) having three or more amino groups include diethylene triamine and triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propioic acid and amino caproic acid. Specific examples of the blocked amines (B6) include ketimine compounds prepared by reacting one of the amines B1 to B5 described above with a ketone such as acetone, methyl ethyl ketone and methyl isobutyl ketone; and oxazoline compounds. Among the above-described amines (B), diamines (B1) and a mixture of the B1 and a smaller amount of B2 are preferably used.

A mixing ratio [NCO]/[NHx] of the content of isocyanate groups in the prepolymer (A) to that of amino groups in the amine (B) is typically from 1/2 to 2/1, preferably from 1.5/1 to 1/1.5, and more preferably from 1.2/1 to 1/1.2. When the mixing ratio is too large or small, molecular weight of the urea-modified polyester decreases, resulting in deterioration of hot offset resistance of the toner.

The urea-modified polyester may include a urethane bonding as well as a urea bonding. The molar ratio (urea/urethane) of the urea bonding to the urethane bonding is typically from 100/0 to 10/90, preferably from 80/20 to 20/80, and more preferably from 60/40 to 30/70. When the content of the urea bonding is too small, hot offset resistance of the resultant toner deteriorates.

The urea-modified polyester is prepared by a method such as a one-shot method. The PO and the PC are heated to from 150° C. to 280° C. in the presence of a known esterification catalyst such as tetrabutoxy titanate and dibutyltin oxide, and removing produced water while optionally depressurizing to prepare polyester having a hydroxyl group. Next, the polyisocyanate (PIC) is reacted with the polyester at from 40° C. to 140° C. to form a polyester prepolymer (A) having an isocyanate group. Further, the amines (B) are reacted with the polyester prepolymer (A) at from 0° C. to 140° C. to form a urea-modified polyester.

When the polyisocyanate (PIC), and the polyester prepolymer (A) and the amines (B) are reacted, a solvent may optionally be used. Specific examples of the solvents include inactive solvents with the PIC such as aromatic solvents (e.g., toluene and xylene), ketones (e.g., acetone, methyl ethyl ketone and methyl isobutyl ketone), esters (e.g., ethyl acetate), amides (e.g., dimethylformamide and dimethylacetamide), and ethers (e.g., tetrahydrofuran).

A reaction terminator may optionally be used in the cross-linking and/or the elongation reaction between the polyester prepolymer (A) and the amines (B) to control a molecular weight of the resultant urea-modified polyester. Specific examples of the reaction terminators include monoamines (e.g., diethylamine, dibutylamine, butylamine and laurylamine), and their blocked compounds (e.g., ketimine compounds).

The weight-average molecular weight of the urea-modified polyester is not less than 10,000, preferably from 20,000 to 10,000,000, and more preferably from 30,000 to 1,000,000. When the weight-average molecular weight is too small, hot offset resistance of the resultant toner deteriorates. The number-average molecular weight of the urea-modified polyester is not particularly limited when the above-described unmodified polyester resin is used in combination. Specifically, the weight-average molecular weight of the urea-modified polyester resins has priority over the number-average molecular weight thereof. However, when the urea-modified polyester is used alone, the number-average molecular weight is from 2,000 to 15,000, preferably from 2,000 to 10,000, and more preferably from 2,000 to 8,000. When the number-average molecular weight is too large, low temperature fixability of the resultant toner and glossiness of full-color images deteriorate.

A combination of the urea-modified polyester and the unmodified polyester improves low temperature fixability of the resultant toner and glossiness of full-color images produced thereby, and is more preferably used than using the urea-modified polyester alone. Further, the unmodified polyester may include modified polyester other than the urea-modified polyester.

It is preferable that the urea-modified polyester at least partially mixes with the unmodified polyester to improve the low temperature fixability and hot offset resistance of the resultant toner. Therefore, the urea-modified polyester preferably has a composition similar to that of the unmodified polyester.

A mixing ratio between the unmodified polyester and the urea-modified polyester is from 20/80 to 95/5, preferably from 70/30 to 95/5, more preferably from 75/25 to 95/5, and even more preferably from 80/20 to 93/7. When the content of the urea-modified polyester is too small, the hot offset resistance deteriorates, and in addition, it is disadvantageous to have both high temperature preservability and low temperature fixability.

The binder resin including the unmodified polyester and urea-modified polyester preferably has a glass transition temperature (Tg) of from 45° C. to 65° C., and preferably from 45° C. to 60° C. When the glass transition temperature is too low, the high temperature preservability of the toner deteriorates. By contrast, when the glass transition temperature is too high, the low temperature fixability deteriorates.

Because the urea-modified polyester is likely to be present on a surface of the parent toner, the resultant toner has better heat resistance preservability than known polyester toners even though the glass transition temperature of the urea-modified polyester is low.

(Colorant)

Specific examples of the colorants for use in the toner of the present invention include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR1, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL, and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, etc. These materials can be used alone or in combination. The toner preferably includes a colorant in an amount of from 1% to 15% by weight, and more preferably from 3% to 10% by weight.

The colorant for use in the present invention can be combined with a resin to be used as a master batch. Specific examples of the resin for use in the master batch include, but are not limited to, styrene polymers and substituted styrene polymers (e.g., polystyrenes, poly-p-chlorostyrenes, and polyvinyltoluenes), copolymers of vinyl compounds and the above-described styrene polymers or substituted styrene polymers, polymethyl methacrylates, polybutyl methacrylates, polyvinyl chlorides, polyvinyl acetates, polyethylenes, polypropylenes, polyesters, epoxy resins, epoxy polyol resins, polyurethanes, polyamides, polyvinyl butyrals, polyacrylic acids, rosins, modified rosins, terpene resins, aliphatic or alicyclic hydrocarbon resins, aromatic petroleum resins, chlorinated paraffins, paraffin waxes, etc. These resins can be used alone or in combination.

(Charge Controlling Agent)

The toner of the present invention may optionally include a charge controlling agent. Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, and salicylic acid derivatives, but are not limited thereto. Specific examples of commercially available charge controlling agents include, but are not limited to, BONTRON® N-03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LR1-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc. Among the above-described examples, materials negatively charging the toner are preferably used.

The content of the charge controlling agent is determined depending on the species of the binder resin used, and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large a charge quantity, and thereby the electrostatic force of the developing roller attracting the toner increases, resulting in deterioration of the fluidity of the toner and image density of the toner images.

(Release Agent)

A wax for use in the toner as a release agent has a low melting point of from 50° C. to 120° C. When such a wax is included in the toner, the wax is dispersed in the binder resin and serves as a release agent at a location between a fixing roller and the toner particles. Accordingly, hot offset resistance can be improved without applying a release agent, such as oil, to the fixing roller. Specific examples of the release agent include natural waxes including vegetable waxes such as carnauba wax, cotton wax, Japan wax and rice wax; animal waxes such as bees wax and lanolin; mineral waxes such as ozokelite and ceresine; and petroleum waxes such as paraffin waxes, microcrystalline waxes, and petrolatum.

In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes, and ether waxes. Further, fatty acid amides such as 1,2-hydroxylstearic acid amide, stearic acid amide, and phthalic anhydride imide; and low molecular weight crystalline polymers such as acrylic homopolymer and copolymers having a long alkyl group in their side chain such as poly-n-stearyl methacrylate, poly-n-laurylmethacrylate, and n-stearyl acrylate-ethyl methacrylate copolymers can also be used.

The above-described charge control agents and release agents can be dissolved and dispersed after kneaded upon application of heat together with a master batch pigment and a binder resin, and can be added when directly dissolved or dispersed in an organic solvent.

(External Additives)

The toner particles are preferably mixed with an external additive to assist in improving the fluidity, developing property and charging ability of the toner particles. Preferable external additives include inorganic fine particles. The inorganic fine particles preferably have a primary particle diameter of from $5\times10^{-3}$ to $5\times10^{2}$ μm, and more preferably from $5\times10^{-3}$ μm to $5\times10^{0.5}$ μm. In addition, the inorganic fine particles preferably have a specific surface area measured by a BET method of from 20 $m^2/g$ to 500 $m^2/g$. The content of the external additive is preferably from 0.01% to 5% by weight, and more preferably from 0.01% to 2.0% by weight, based on total weight of the toner composition. Specific examples of the inorganic fine particles include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Among the above-described examples, a combination of a hydrophobic silica and a hydrophobic titanium oxide is preferably used. In particular, the hydrophobic silica and the hydrophobic titanium oxide each having an average particle diameter of not greater than $5\times10^{-4}$ μm considerably improves an electrostatic force between the toner particles and van der Waals force. Accordingly, the resultant toner composition has a proper charge quantity. In addition, even when the toner composition is agitated in the developing devices 5, the external additive is hardly released from the toner particles. As a result, image defects such as white spots and image omissions are hardly produced. Further, the amount of residual toner after transfer can be reduced. When titanium oxide fine particles are used as the external additive, the resultant toner can reliably form toner images having a proper image density even when environmental conditions are changed. However, the charge rising properties of the resultant toner tend to deteriorate. Therefore, an additive amount of the titanium oxide fine particles is preferably smaller than that of silica fine particles. The total additive amount of hydrophobic silica fine particles and hydrophobic titanium oxide fine particles is preferably from 0.3% to 1.5% by weight based on weight of the toner particles to reliably form higher-quality images without degrading charge rising properties even when images are repeatedly formed.

A method for manufacturing the toner is described in detail below, but is not limited thereto.

(Method for Manufacturing Toner)

(1) The colorant, the unmodified polyester, the polyester prepolymer having an isocyanate group, and the release agent are dispersed in an organic solvent to obtain toner constituent liquid.

From the viewpoint of easy removal after formation of parent toner particles, it is preferable that the organic solvent be volatile and have a boiling point of not greater than 100° C. Specific examples of the organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethylketone, and methylisobutylketone. The above-described materials can be used alone or in combination. In particular, aromatic solvent such as toluene and xylene, and chlorinated hydrocarbon such as methylene chloride, 1,2-dichloroethane, chloroform, and carbon tetrachloride are preferably used. The toner constituent liquid preferably includes the organic solvent in an amount of from 0 to 300 parts by weight, more preferably from 0 to 100 parts by weight, and even more preferably from 25 to 70 parts by weight based on 100 parts by weight of the prepolymer.

(2) The toner constituent liquid is emulsified in an aqueous medium under the presence of a surfactant and a particulate resin.

The aqueous medium may include water alone or a mixture of water and an organic solvent. Specific examples of the organic solvent include alcohols such as methanol, isopropanol, and ethylene glycol; dimethylformamide; tetrahydrofuran; cellosolves such as methyl cellosolve; and lower ketones such as acetone and methyl ethyl ketone.

The toner constituent liquid includes the aqueous medium in an amount of from 50 to 2,000 parts by weight, and preferably from 100 to 1,000 parts by weight based on 100 parts by weight of the toner constituent liquid. When the amount of the aqueous medium is too small, the toner constituent liquid is not well dispersed and toner particles having a predetermined particle diameter cannot be formed. By contrast, when the amount of the aqueous medium is too large, production costs increase.

A dispersant such as a surfactant or an organic particulate resin is optionally included in the aqueous medium to improve the dispersion therein.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives, and imidazoline) and quaternary ammonium salts (e.g., alkyltrimethyl ammonium salts, dialkyldimethyl ammonium salts, alkyldimethyl benzyl ammonium salts, pyridinium salts, alkyl isoquinolinium salts, and benzethonium chloride); nonionic surfactants such as fatty acid amide derivatives and polyhydric alcohol derivatives; and ampholytic surfactants such as alanine, dodecyldi(aminoethyl)glycin, di(octylaminoethyle)glycin, and N-alkyl-N,N-dimethylammonium betaine.

A surfactant having a fluoroalkyl group can achieve a dispersion having high dispersibility even when a smaller amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3[ω-fluoroalkyl(C6-C11)oxy]-1-alkyl(C3-C4) sulfonate, sodium 3-[ω-fluoroalkanoyl(C6-C8)-N-ethylamino]-1-propane sulfonate, fluoroalkyl(C11-C20) carboxylic acids and their metal salts, perfluoroalkylcarboxylic acids (C7-C13) and their metal salts, perfluoroalkyl(C4-C12) sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonylglycin, and monoperfluoroalkyl(C6-C16) ethylphosphates.

Specific examples of commercially available surfactants include SURFLON® S-111, SURFLON® S-112, and SURFLON® S-113 manufactured by AGC Seimi Chemical Co., Ltd.; FRORARD FC-93, FC-95, FC-98, and FC-129 manufactured by Sumitomo 3M Ltd.; UNIDYNE DS-101 and DS-102 manufactured by Daikin Industries, Ltd.; MEGAFACE F-110, F-120, F-113, F-191, F-812, and F-833 manufactured by DIC Corporation; EFTOP EF-102, EF-103, EF-104, EF-105, EF-112, EF-123A, EF-123B, EF-306A, EF-501, EF-201, and EF-204 manufactured by JEMCO Inc.; and FUTARGENT F-100 and F-150 manufactured by Neos Co., Ltd.

Specific examples of cationic surfactants include primary and secondary aliphatic amines or secondary amino acid having a fluoroalkyl group, aliphatic quaternary ammonium salts such as perfluoroalkyl(C6-C10)sulfoneamidepropyltrimethylammonium salts, benzalkonium salts, benzetonium chloride, pyridinium salts, and imidazolinium salts. Specific examples of commercially available products thereof include SURFLON® S-121 manufactured by AGC Seimi Chemical Co., Ltd.; FRORARD FC-135 manufactured by Sumitomo 3M Ltd.; UNIDYNE DS-202 manufactured by Daikin Industries, Ltd.; MEGAFACE F-150 and F-824 manufactured by DIC Corporation; EFTOP EF-132 manufactured by JEMCO Inc.; and FUTARGENT F-300 manufactured by Neos Co., Ltd.

The resin particles are added to stabilize parent toner particles formed in the aqueous medium. Therefore, the resin particles are preferably added so as to have a coverage of from 10% to 90% over a surface of the parent toner particles. Specific examples of the resin particles include polymethylmethacrylate particles having a particle diameter of 1 μm and 3 μm, polystyrene particles having a particle diameter of 0.5 μm and 2 μm, and poly(styrene-acrylonitrile) particles having a particle diameter of 1 μm. Specific examples of commercially available products thereof include PB-200H manufactured by Kao Corporation, SGP manufactured by Soken Chemical & Engineering Co., Ltd., Technopolymer SB manufactured by Sekisui Plastics Co., Ltd., SGP-3G manufactured by Soken Chemical & Engineering Co., Ltd., and Micropearl manufactured by Sekisui Chemical Co., Ltd. In addition, inorganic dispersants such as tricalcium phosphate, calcium carbonate, titanium oxide, colloidal silica, and hydroxy apatite can also be used.

As dispersants which can be used in combination with the above-described resin particles and inorganic dispersants, it is possible to stably disperse toner constituents in water using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid, and maleic anhydride), (meth)acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, glycerinmonomethacrylic acid esters, N-methylolacrylamide, and N-methylolmethacrylamide), vinyl alcohol and its ethers (e.g., vinyl methyl ether, vinyl ethyl ether, and vinyl propyl ether), esters of vinyl alcohol with a compound having a carboxyl group (e.g., vinyl acetate, vinyl propionate, and vinyl butyrate), acrylic amides (e.g., acrylamide, methacrylamide, and diacetoneacrylamide) and their methylol compounds, acid chlorides (e.g., acrylic acid chloride and methacrylic acid chloride), nitrogen-containing compounds (e.g., vinyl pyridine, vinyl pyrrolidone, vinyl imidazole, and ethylene imine), and homopolymer or copolymer having heterocycles of the nigtroge-containing compounds. In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters), and cellulose compounds (e.g., methyl cellulose, hydroxyethyl cellulose, and hydroxypropyl cellulose) can also be used as the polymeric protective colloid.

The dispersion method is not particularly limited, and well-known methods such as low speed shearing methods, high-speed shearing methods, friction methods, high-pressure jet methods, and ultrasonic methods can be used. Among the above-described methods, the high-speed shearing methods are preferably used because particles having a particle diameter of from 2 μm to 20 μm can be easily prepared. When a high-speed shearing type dispersion machine is used, the rotation speed is not particularly limited, but the rotation speed is typically from 1,000 rpm to 30,000 rpm, and preferably from 5,000 rpm to 20,000 rpm. The dispersion time is not particularly limited, but is typically from 0.1 to 5 minutes for a batch method. The temperature in the dispersion process is typically from 0° C. to 150° C. (under pressure), and preferably from 40° C. to 98° C.

(3) While the emulsion is prepared, amines (B) are added thereto to react with the polyester prepolymer (A) having an isocyanate group.

This reaction is accompanied by cross-linking and/or elongation of a molecular chain. The reaction time depends on reactivity of an isocyanate structure of the polyester prepolymer (A) and amines (B), but is typically from 10 minutes to 40 hours, and preferably from 2 to 24 hours. The reaction temperature is typically from 0° C. to 150° C., and preferably from 40° C. to 98° C. In addition, a known catalyst such as dibutyltinlaurate and dioctyltinlaurate can be used as needed.

(4) After completion of the reaction, the organic solvent is removed from the emulsified dispersion (a reactant), and subsequently, the resulting material is washed and dried to obtain a parent toner particle.

The prepared emulsified dispersion is gradually heated while stirred in a laminar flow, and an organic solvent is removed from the dispersion after stirred strongly when the dispersion has a specific temperature to form a parent toner particle having the shape of a spindle. When an acid such as calcium phosphate or a material soluble in alkaline is used as a dispersant, the calcium phosphate is dissolved with an acid such as a hydrochloric acid, and washed with water to remove the calcium phosphate from the parent toner particle. Besides the above-described method, the organic solvent can also be removed by an enzymatic hydrolysis.

(5) A charge control agent is provided to the parent toner particle, and inorganic fine particles such as silica fine particles and titanium oxide fine particles are added thereto to obtain toner. Well-known methods using a mixer or the like are used to provide the charge control agent and to add the inorganic fine particles.

Accordingly, toner having a smaller particle diameter and a sharper particle diameter distribution can be easily obtained. Further, the strong agitation in the process of removing the organic solvent can control the toner to have a shape between a spherical shape and a spindle shape, and a surface morphology between a smooth surface and a rough surface.

Figure 19A:
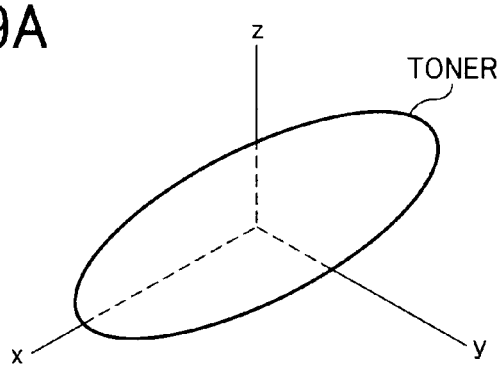
FIGS. 19A, 19B, and 19C are schematic views illustrating a shape of a toner particle, respectively.
Figure 19B:
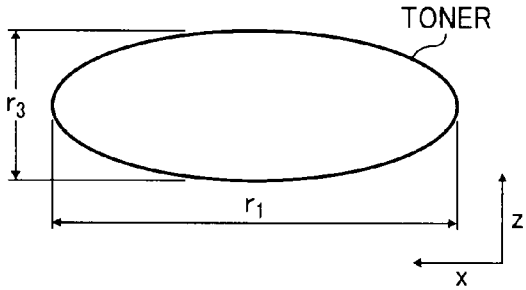
Figure 19C:
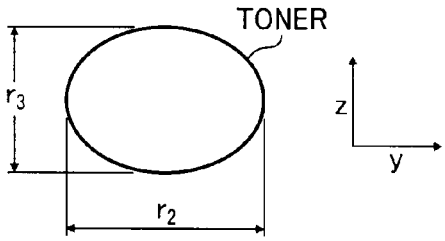

The toner used in the image forming apparatus 50 according to illustrative embodiments has a substantially spherical shape that can be defined as follows. FIGS. 19A to 19C are schematic views respectively illustrating a shape of the toner. As illustrated in FIG. 19A, the toner has a substantially spherical shape with a long axis r1, a short axis r2, and a thickness r3 that satisfy a relationship of r1≥r2≥r3. As illustrated in FIG. 19B, it is preferable that a ratio (r2/r1) of the short axis r2 to the long axis r1 be in a range of from 0.5 to 1.0, and as illustrated in FIG. 19C, a ratio (r3/r2) of the thickness r3 to the short axis r2 be in a range of from 0.7 to 1.0. When the ratio (r2/r1) of the short axis r2 to the long axis r1 is less than 0.5, a shape of the toner is not spherical, and both dot-reproductivity and transfer efficiency are decreased. Consequently, higher image quality cannot be obtained. When the ratio (r3/r2) of the thickness r3 to the short axis r2 is less than 0.7, a shape of the toner is flattened. Consequently, a high transfer ratio as obtained when the toner is spherical cannot be achieved. In particular, when the ratio (r3/r2) of the thickness r3 to the short axis r2 is 1.0, the toner is rotated around the long axis r1 as a rotary shaft, thereby improving flowability of the toner.

Each of r1, r2, r3 is measured by taking pictures of the toner by a scanning electron microscope (SEM) at different viewing angles.

Figure 20:
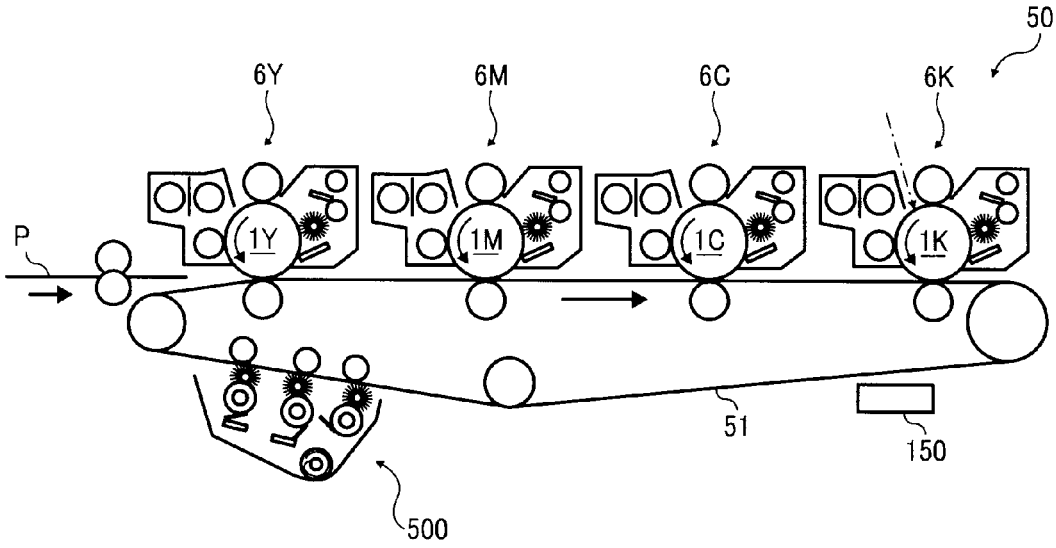
FIG. 20 is a vertical cross-sectional view illustrating an example of a configuration of an image forming apparatus employing a tandem-type direct transfer system.

The belt cleaning device 100 according to the foregoing illustrative embodiments is also applicable to a conveyance belt cleaning device 500 that cleans a conveyance belt 51 illustrated in FIG. 20. FIG. 20 is a schematic view illustrating a configuration of the image forming apparatus 50 employing a tandem-type direct transfer system.

As illustrated in FIG. 20, the conveyance 51 included in the image forming apparatus 50 employing the tandem-type direct transfer system contacts each of the photoconductors 1 to form transfer nips therebetween. The conveyance belt 51 is rotated in a clockwise direction in FIG. 20 while bearing the sheet P so as to sequentially convey the sheet P to each of the transfer nips. As a result, the toner images of the respective colors are directly transferred onto the sheet P from the surfaces of the photoconductors 1, and are sequentially superimposed one atop the other on the sheet P to form a full-color toner image on the sheet P. Foreign substances or toner attached to the conveyance belt 51 after passing through the transfer nip between the conveyance belt 51 and the photoconductor 1K are removed by the conveyance belt cleaning device 500. The optical sensor unit 150 is provided opposite the conveyance belt 51 with a predetermined interval therebetween. In the image forming apparatus 50 illustrated in FIG. 20, image density is controlled and an amount of positional shift is collected at a predetermined timing to form a predetermined toner pattern such as the graduation patterns S and the chevron patch PV on the conveyance belt 51. The toner pattern thus formed is detected by the optical sensor unit 150 to perform predetermined correction or control based on the result thus detected. The untransferred toner pattern after detected by the optical sensor unit 150 is removed from the conveyance belt 51 by the conveyance belt cleaning device 500. Thus, the conveyance belt 51 functions as the image carrier that carries the toner image.

Thus, the belt cleaning device 100 employed as the conveyance belt cleaning device 500 can reliably remove the toner pattern formed on the conveyance belt 51, thereby preventing a back surface of the sheet P from being stained with toner or the like.

Figure 21:
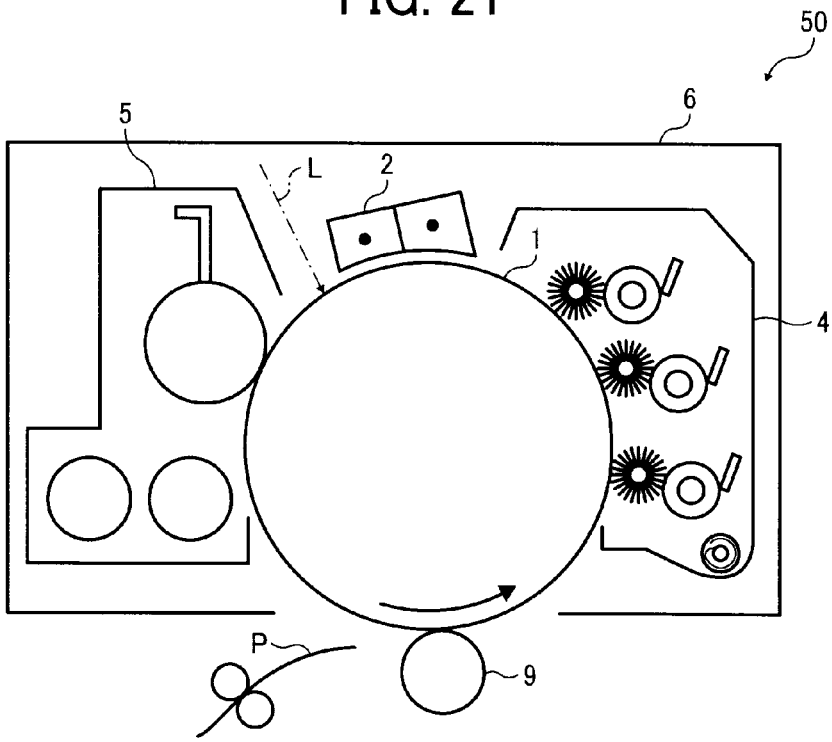
FIG. 21 is a schematic view illustrating another example of a configuration of a process unit included in the image forming apparatus.

In addition, the belt cleaning device 100 is applicable to the drum cleaning device 4 as illustrated in FIG. 21. FIG. 21 is a schematic view illustrating another example of a configuration of the process unit 6.

The untransferred toner image such as the toner consumption pattern formed during the refresh mode or a toner image remaining on the photoconductor 1 upon a sheet jam is conveyed to the drum cleaning device 4. Thus, the drum cleaning device 4 employing the belt cleaning device 100 can reliably remove the untransferred toner image. It is to be noted that the belt cleaning device 100 according to the second illustrative embodiment is employed as the drum cleaning device 4.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. A cleaning device, disposed downstream from a transfer position where a toner image formed on an image carrier is transferred onto a transfer member in a direction of rotation of the image carrier to remove toner from the image carrier, the cleaning device comprising:

a normally-charged toner cleaning member, to which a voltage having a polarity opposite a normal charging polarity of the toner is applied, provided in contact with the image carrier to electrostatically remove normally-charged toner from the image carrier;

one of a polarity controller provided on an upstream side from the normally-charged toner cleaning member in the direction of rotation of the image carrier to control the toner on the image carrier to have the normal charging polarity and a reversely-charged toner cleaning member, to which a voltage having the same polarity as the normal charging polarity of the toner is applied, provided in contact with the image carrier on the upstream side from the normally-charged toner cleaning member to electrostatically remove reversely-charged toner from the image carrier;

a pre-cleaning member, to which a voltage having the polarity opposite the normal charging polarity of the toner is applied, provided in contact with the image carrier on the extreme upstream side in the direction of rotation of the image carrier to electrostatically remove normally-charged toner from the image carrier;

a pre-collection member, to which a voltage having the same polarity as and greater than the voltage applied to the pre-cleaning member is applied, provided in contact with the pre-cleaning member to electrostatically collect the toner from the pre-cleaning member; and a control unit to reduce the voltage applied to the pre-cleaning member immediately after an untransferred toner image, which is not transferred from the image carrier onto the transfer member at the transfer position, is removed from the image carrier by the pre-cleaning member below a voltage applied to the pre-cleaning member during removal of the untransferred toner image.

2. The cleaning device according to claim 1, wherein the voltage applied to the pre-cleaning member is reduced based on an amount of toner on the image carrier conveyed to the pre-cleaning member.

3. The cleaning device according to claim 2, wherein the voltage applied to the pre-cleaning member during removal of residual toner remaining on the image carrier after the transfer of the toner image onto the transfer member is smaller than the voltage applied to the pre-cleaning member during the removal of the untransferred toner image.

4. The cleaning device according to claim 1, wherein the control unit generates a predetermined electric potential difference between the pre-cleaning member and the pre-collection member by adjusting the voltage applied to the pre-collection member.

5. The cleaning device according to claim 1, further comprising a charging member to charge the toner attached to the pre-cleaning member to a polarity opposite the polarity of the voltage applied to the pre-cleaning member.

6. The cleaning device according to claim 5, wherein the charging member is disposed upstream from a contact portion between the pre-cleaning member and the pre-collection member in a direction of rotation of the pre-cleaning member and downstream from a contact portion between the image carrier and the pre-cleaning member in the direction of rotation of the pre-cleaning member.

7. The cleaning device according to claim 1, wherein an amount of toner in the untransferred toner image is not less than 0.6 mg/cm$^2$.

8. The cleaning device according to claim 1, wherein each of the cleaning members comprises a brush roller.

9. A cleaning device, disposed downstream from a transfer position where a toner image formed on an image carrier is transferred onto a transfer member in a direction of rotation of the image carrier to remove toner from the image carrier, the cleaning device comprising:

a normally-charged toner cleaning member, to which a voltage having a polarity opposite a normal charging polarity of the toner is applied, provided in contact with the image carrier to electrostatically remove normally-charged toner from the image carrier;

one of a polarity controller, to which a voltage having the same polarity as the normal charging polarity of the toner is applied, provided on an upstream side from the normally-charged toner cleaning member in the direction of rotation of the image carrier to control the toner on the image carrier to have the normal charging polarity, and a reversely-charged toner cleaning member, to which a voltage having the same polarity as the normal charging polarity of the toner is applied, provided in contact with the image carrier on an upstream side from the normally-charged toner cleaning member to electrostatically remove reversely-charged toner from the image carrier;

a pre-cleaning member, to which a voltage having the polarity opposite the normal charging polarity of the toner is applied, provided in contact with the image carrier on the extreme upstream side in the direction of rotation of the image carrier to electrostatically remove normally-charged toner from the image carrier;

a pre-collection member, to which a voltage having the same polarity as and greater than the voltage applied to the pre-cleaning member is applied, provided in contact with the pre-cleaning member to electrostatically collect the toner from the pre-cleaning member;

an electrically grounded pre-opposing member provided opposite the pre-cleaning member with the image carrier interposed therebetween; and a separation member to separate the pre-opposing member from the image carrier.

10. The cleaning device according to claim 9, wherein the separation member separates the pre-opposing member from the image carrier immediately after an untransferred toner image, which is not transferred from the image carrier onto the transfer member at the transfer position, is removed from the image carrier by the pre-cleaning member.

11. The cleaning device according to claim 9, wherein the separation member is a solenoid.

12. An image forming apparatus, comprising:

an image carrier on which a toner image to be transferred onto a transfer member at a transfer position is formed; and the cleaning device according to claim 9.

13. An image forming apparatus, comprising:

an image carrier on which a toner image to be transferred onto a transfer member at a transfer position is formed; and a cleaning device disposed downstream from the transfer position in a direction of rotation of the image carrier to remove toner from the image carrier, the cleaning device comprising:

a normally-charged toner cleaning member, to which a voltage having a polarity opposite a normal charging polarity of the toner is applied, provided in contact with the image carrier to electrostatically remove normally-charged toner from the image carrier;

one of a polarity controller provided on an upstream side from the normally-charged toner cleaning member in the direction of rotation of the image carrier to control the toner on the image carrier to have the normal charging polarity and a reversely-charged toner cleaning member, to which a voltage having the same polarity as the normal charging polarity of the toner is applied, provided in contact with the image carrier on the upstream side from the normally-charged toner cleaning member to electrostatically remove reversely-charged toner from the image carrier;

a pre-cleaning member, to which a voltage having the polarity opposite the normal charging polarity of the toner is applied, provided in contact with the image carrier on the extreme upstream side in the direction of rotation of the image carrier to electrostatically remove normally-charged toner from the image carrier;

a pre-collection member, to which a voltage having the same polarity as and greater than the voltage applied to the pre-cleaning member is applied, provided in contact with the pre-cleaning member to electrostatically collect the toner from the pre-cleaning member; and a control unit to reduce the voltage applied to the pre-cleaning member immediately after an untransferred toner image, which is not transferred from the image carrier onto the transfer member at the transfer position, is removed from the image carrier by the pre-cleaning member below a voltage applied to the pre-cleaning member during removal of the untransferred toner image.

14. The image forming apparatus according to claim 13, wherein the image carrier is an intermediate transfer member onto which multiple toner images formed on latent image carriers are sequentially superimposed.

15. The image forming apparatus according to claim 14, wherein the intermediate transfer member is an elastic endless belt.

* * * * *